US009486814B2

(12) United States Patent
Prahlad et al.

(10) Patent No.: US 9,486,814 B2
(45) Date of Patent: Nov. 8, 2016

(54) HANDLING AND SORTING MATERIALS USING ELECTROADHESION

(71) Applicant: SRI International, Menlo Park, CA (US)

(72) Inventors: Harsha Prahlad, Cupertino, CA (US); Joseph S. Eckerle, Woodside, CA (US); Roy D. Kornbluh, Palo Alto, CA (US); Ronald E. Pelrine, Longmont, CO (US)

(73) Assignee: SRI International, Menlo Park, CA (US)

( * ) Notice: Subject to any disclaimer, the term of this patent is extended or adjusted under 35 U.S.C. 154(b) by 214 days.

(21) Appl. No.: 13/886,058

(22) Filed: May 2, 2013

(65) Prior Publication Data

US 2013/0292303 A1 Nov. 7, 2013

Related U.S. Application Data

(60) Provisional application No. 61/641,762, filed on May 2, 2012.

(51) Int. Cl.

| | |
|---|---|
| ***B03C 7/00*** | (2006.01) |
| ***B03C 7/02*** | (2006.01) |
| ***B03C 7/04*** | (2006.01) |
| ***B03C 7/08*** | (2006.01) |

(52) U.S. Cl.

CPC . *B03C 7/02* (2013.01); *B03C 7/04* (2013.01); *B03C 7/08* (2013.01); *B03C 2201/20* (2013.01)

(58) Field of Classification Search

CPC ..... B03C 7/00; B03C 7/02; B03C 7/04; B03C 7/08; B03C 2201/20; H01L 21/683; H01L 21/6831; H01L 21/6833

USPC ..... 209/127.1–130, 213, 218

See application file for complete search history.

(56) References Cited

U.S. PATENT DOCUMENTS

| | | | | |
|---|---|---|---|---|
| 7,551,419 | B2 * | 6/2009 | Pelrine et al. | 361/234 |
| 2011/0193362 | A1 | 8/2011 | Prahlad et al. | |
| 2011/0272329 | A1 * | 11/2011 | Friedlaender | 209/129 |

FOREIGN PATENT DOCUMENTS

| | | | |
|---|---|---|---|
| EP | 2384818 | A1 | 11/2011 |
| JP | 2003285289 | A | 10/2003 |

OTHER PUBLICATIONS

PCT International Search Report and Written Opinion, PCT International Application No. PCT/US2013/039312, dated Nov. 13, 2013.

* cited by examiner

*Primary Examiner* — Joseph C Rodriguez
*Assistant Examiner* — Kalyanavenkateshware Kumar
(74) *Attorney, Agent, or Firm* — McDonnell Boehnen Hulbert & Berghoff LLP

(57) ABSTRACT

A process for sorting materials using material-selective electroadhesive grippers is disclosed. At least one of an electroadhesive surface or a plurality of articles is manipulated such that multiple ones of the plurality of articles are at least intermittently proximate the electroadhesive surface. Voltage is applied to one or more electrodes in the electroadhesive surface to thereby cause the electroadhesive surface to selectively adhere to a subset of the plurality of articles based on the subset of the plurality of articles having different material properties than others of the plurality of articles. While the voltage is applied, the electroadhesive surface is moved with respect to the others of the plurality of articles to thereby separate the subset of the plurality of articles from the others of the plurality of articles.

17 Claims, 16 Drawing Sheets

HANDLING AND SORTING MATERIALS USING ELECTROADHESION

CROSS-REFERENCE TO RELATED APPLICATIONS

This application claims priority to U.S. Provisional Patent Application No. 61/641,762, filed May 2, 2012, which is incorporated herein by reference in its entirety and for all purposes.

BACKGROUND

Unless otherwise indicated herein, the materials described in this section are not prior art to the claims in this application and are not admitted to be prior art by inclusion in this section.

The mass production of products has led to many innovations over the years. Substantial developments have been made in the industrial handling of various materials and items, particularly in the area of robotics. For example, various types of robotics and other automated systems are now used in order to "pick and place" items during many manufacturing and other materials handling processes. Such robotics and other systems can include robot arms that, for example, grip, lift and/or place an item as part of a designated process. Of course, other manipulations and materials handling techniques can also be accomplished by way of such robotics or other automated systems. Despite many advances over the years in this field, there are limitations as to what can be handled in such a manner.

Conventional robotic grippers typically use either suction or a combination of large normal forces and fine control with mechanical actuation in order to grip objects. Such techniques have several drawbacks. For example, the use of suction tends to require smooth, clean, dry and generally flat surfaces, which limits the types and conditions of objects that can be gripped. Suction also tends to require a lot of power for the pumps and is prone to leaks at any location on a vacuum or low pressure seal, with a resulting loss of suction being potentially catastrophic. The use of mechanical actuation often requires large normal or "crushing" forces against an object, and also tends to limit the ability to robotically grip fragile or delicate objects. Producing large forces also increases the cost of mechanical actuation. Mechanical pumps and conventional mechanical actuation with large crushing forces also often require substantial weight, which is a major disadvantage for some applications, such as the end of a robot arm where added mass must be supported. Furthermore, even when used with sturdy objects, robotic arms, mechanical claws and the like can still leave damaging marks on the surface of the object itself.

SUMMARY

Some examples relate to material-selective electroadhesive surfaces and devices that can be selectively adhered to certain objects based on properties of those objects. Such an electroadhesive surface can include electrodes that are configured to induce an electrostatic attraction with nearby objects when an appropriate voltage is applied to the electrodes. In some cases the electrode polarization can induce a corresponding polarization in nearby object to effect adhesion of the object to the electroadhesive surface.

Sorting and handling techniques are disclosed herein that employ electroadhesive surfaces that selectively adhere to objects based on a variety of factors. In some cases, electroadhesive surfaces can be tuned to adhere to certain objects based on an electrode pattern and/or an applied voltage. For example, objects can be selectively adhered based on material composition, surface area, weight, and/or thickness that differs from other objects. Additionally or alternatively, objects can be selectively adhered based on input from sensing systems that identify and/or characterize objects based on identifying information (e.g., recognizable images, barcodes, and/or characters, RFID signature, object dimensions, shape, reflectivity, weight, etc.). Objects that adhere can then be treated differently than objects that do not adhere, to thereby effect a sorting operation. For example, relative motion between the electroadhesive surface and any non-adhered objects separates the adhered objects from the non-adhered objects. In some cases, the relative motion may involve the electroadhesive surface changing position with respect to the non-adhered objects.

Some embodiments of the present disclosure provide a method. The method can include manipulating at least one of an electroadhesive surface or a plurality of articles such that multiple ones of the plurality of articles are at least intermittently proximate the electroadhesive surface. The method can include applying a voltage to one or more electrodes in the electroadhesive surface to thereby cause the electroadhesive surface to selectively adhere to a subset of the plurality of articles based on the subset of the plurality of articles having different material properties than others of the plurality of articles. The method can include moving the electroadhesive surface with respect to the others of the plurality of articles to thereby separate the subset of the plurality of articles from the others of the plurality of articles, while applying the voltage to the one or more electrodes in the electroadhesive surface.

Some embodiments of the present disclosure provide a system. The system can include an electroadhesive surface including one or more electrodes, a power supply, an article manipulator, and a controller. The power supply can be configured to apply voltage to the one or more electrodes via one or more terminals. The article manipulator can be configured to convey the plurality of articles to the electroadhesive surface such that multiple ones of the plurality of articles are at least intermittently proximate the electroadhesive surface. The controller can be configured to: (i) control the power supply to apply a voltage to the one or more electrodes in the electroadhesive surface to thereby cause the electroadhesive surface to selectively adhere to a subset of the plurality of articles based on the subset of the plurality of articles having different material properties than others of the plurality of articles, and (ii) while the voltage is applied to the one or more electrodes in the electroadhesive surface, cause the electroadhesive surface to move with respect to the others of the plurality of articles to thereby separate the subset of the plurality of articles from the others of the plurality of articles.

These as well as other aspects, advantages, and alternatives, will become apparent to those of ordinary skill in the art by reading the following detailed description, with reference where appropriate to the accompanying drawings.

DETAILED DESCRIPTION

Figure 1A:
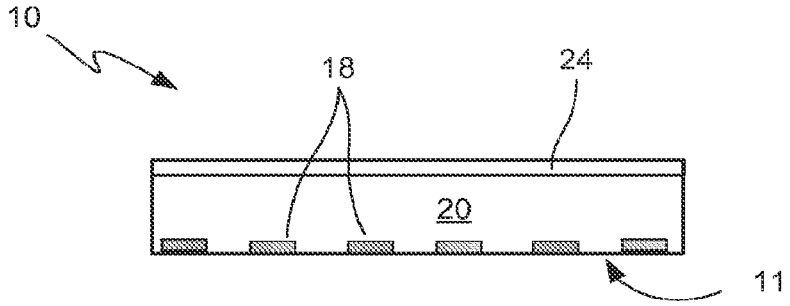
FIG. 1A is a side cross-section of an example electroadhesive end effector.

In the following detailed description, reference is made to the accompanying figures, which form a part hereof. In the figures, similar symbols typically identify similar components, unless context dictates otherwise. The illustrative embodiments described in the detailed description, figures, and claims are not meant to be limiting. Other embodiments may be utilized, and other changes may be made, without departing from the scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

I. Overview

Some embodiments of the present disclosure find application in material handling and sorting. Electroadhesive surfaces can be configured to exhibit object-selective electroadhesive effects. In some examples, object selectivity can be achieved by material-selective electrode patterns can be used to cause a gripper to adhere to articles formed substantially of a particular material without adhering to articles formed substantially of another material. In some examples, object selectivity can be achieved by material-selective voltages can be used to cause a gripper to adhere to articles formed substantially of a particular material without adhering to articles formed substantially of another material. The material-selective responsiveness of a particular electroadhesive gripper can therefore depend on a combination of the voltage applied to the grippers electrodes, and the arrangement of those electrodes. Generally, the electroadhesive interaction with a particular material may also depend on the susceptibility of the material to generate an induced electroadhesion by local electrical polarization (e.g., the conductivity of the particular material) as well as the weight and/or density of the article being manipulated, among other factors. Such a material-selective electroadhesive gripper can be used to separate articles formed of the particular material (or including the particular material) from an intermixed group of articles formed of a variety of materials. In other examples, object selectivity can be achieved by controlling the voltage applied to the electroadhesive surface based on a control system that provides an external on/off signal with varying magnitudes. This external signal may be in turn triggered by a variety of sensors configured to identify and/or characterize item-identifying information on such objects, such as barcodes or other recognize patterns, RFID, X-ray, vision systems, etc. or other sensing systems including capacitive sensors, weight sensors, infrared sensors, etc. based on some overall sorting objective that can be achieved by tuning the electroadhesive effect on-demand (e.g., dynamically and in real time).

Given the ability to selectively adhere to items composed of various materials, sorting systems may be created that use one or more material-selective electroadhesive grippers to sort a group of intermixed articles based at least in part on the composition of such articles. Such material-selective sorting systems may find applications in recycling handling applications where recyclable items are sorted by composition for further processing. Material-selective grippers allow for at least partially automating sorting routines. The material-dependent differential electroadhesive response can then be used to separate articles that adhere to the gripper from those that do not. For example, while articles are adhered to a gripper, the gripper can be moved with respect to the non-adhered articles. Once separated from the group, the adhered articles can be released from the gripper (e.g., by turning off or reducing the voltage on the electrodes).

II. Example Electroadhesive Systems

The present disclosure relates in various embodiments to an electroadhesive gripping device or system adapted to handle objects and materials. In particular, such an electroadhesive gripping system can be adapted to hold, move or even pick and place a wide variety of objects, including small, dirty and/or fragile objects. Such handling can be accomplished with minimal mechanical or "crushing" forces from the gripping system onto the foreign object, due to the use of mostly electroadhesive forces. In addition to the moving and picking and placement of items, further applications of the provided electroadhesive gripping system are also possible, such that it will be understood that the provided electroadhesive gripping system is not limited to use to such applications.

2a) Electroadhesion

As the term is used herein, 'electroadhesion' refers to the mechanical coupling of two objects using electrostatic forces. Electroadhesion as described herein uses electrical control of these electrostatic forces to permit temporary and detachable attachment between two objects. This electrostatic adhesion holds two surfaces of these objects together or increases the effective traction or friction between two surfaces due to electrostatic forces created by an applied electric field. In addition to holding two flat, smooth and generally conductive surfaces together, disclosed herein are electroadhesion devices and techniques that do not limit the material properties or surface roughness of the objects subject to electroadhesive forces and handling. In some cases, an electroadhesive surface may be a compliant surface to facilitate electroadhesive attraction independent of surface roughness. For example, the electroadhesive surface may have sufficient flexibility for the surface to follow local non-uniformities and/or imperfections of an exterior surface of an adhered object. For example, the electroadhesive surface can at least partially conform to microscopic, mesoscopic, and/or macroscopic surface features. When an appropriate voltage is applied to such a compliant electroadhesive surface, the electroadhesive surface is attracted to the exterior surface of the adhered object, and the attraction causes the electroadhesive surface to at least partially conform to the exterior surface by flexing locally such that the electroadhesive surface moves toward the exterior surface.

Turning first to FIG. 1A, an example electroadhesive end effector is illustrated in elevated cross-sectional view. Electroadhesive end effector 10 includes one or more electrodes 18 located at or near an "electroadhesive gripping surface" 11 thereof, as well as an insulating material 20 between electrodes and a backing 24 or other supporting structural component. For purposes of illustration, electroadhesive end effector 10 is shown as having six electrodes in three pairs, although it will be readily appreciated that more or fewer electrodes can be used in a given electroadhesive end effector. Where only a single electrode is used in a given electroadhesive end effector, a complimentary electroadhesive end effector having at least one electrode of the opposite polarity is preferably used therewith. With respect to size, electroadhesive end effector 10 is substantially scale invariant. That is, electroadhesive end effector sizes may range from less than 1 square centimeter to greater than several meters in surface area. Even larger and smaller surface areas are also possible, and may be sized to the needs of a given application.

Figure 1B:
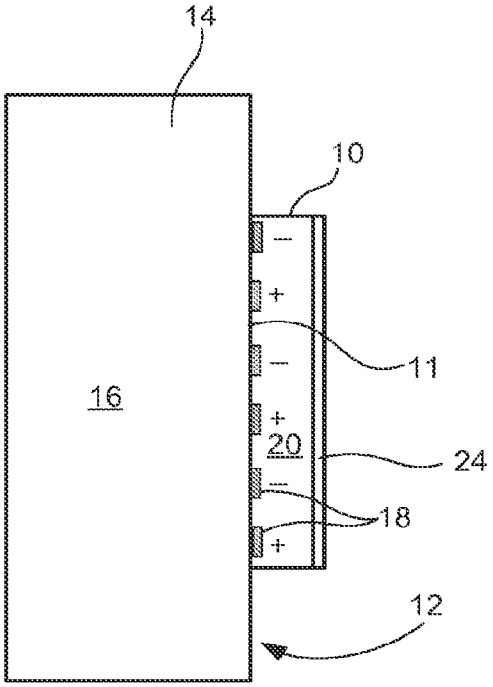
FIG. 1B illustrates in side cross-sectional view the example electroadhesive end effector of FIG. 1A adhered to a foreign object.

FIG. 1B depicts in elevated cross-sectional view of the example electroadhesive end effector 10 of FIG. 1A adhered to a foreign object 14. Foreign object 14 includes surface 12 and inner material 16. Electroadhesive gripping surface 11 of electroadhesive end effector 10 is placed against or nearby surface 12 of foreign object 14. An electrostatic adhesion voltage is then applied via electrodes 18 using external control electronics (not shown) in electrical communication with the electrodes 18. As shown in FIG. 1B, the electrostatic adhesion voltage uses alternating positive and negative charges on neighboring electrodes 18. As a result of the voltage difference between electrodes 18, one or more electroadhesive forces are generated, which electroadhesive forces act to hold the electroadhesive end effector 10 and foreign object 14 against each other. Due to the nature of the forces being applied, it will be readily appreciated that actual contact between electroadhesive end effector 10 and foreign object 14 is not necessary. Rather sufficient proximity to allow the electric field based electroadhesive interaction to take place is all that is necessary. For example, a piece of paper, thin film, or other material or substrate may be placed between electroadhesive end effector 10 and foreign object 14. Furthermore, although the term "contact" is used herein to denote the interaction between an electroadhesive end effector and a foreign object, it will be understood that actual direct surface to surface contact is not always required, such that one or more thin objects such as an insulator, can be disposed between an end effector or electroadhesive gripping surface and the foreign object. In some embodiments such an insulator between the gripping surface and foreign object can be a part of the end effector, while in others it can be a separate item or device.

Additionally or alternatively, there may be a gap between the electroadhesive gripping surface and the object being gripped and this gap can be decreased upon activation of the electroadhesive force. For example, the electroadhesive force can cause the electroadhesive gripping surface to move closer to the exterior surface of the object being gripped so as to close the gap. Moreover, the electroadhesive attraction can cause the gripping surface to move toward the exterior surface of the object being gripped at multiple points across the surface area of the gripping surface. For example, the compliant gripping surface to conform to the exterior surface microscopically, mesoscopically, and/or macroscopically. Such local gap-closing by the gripping surface can thereby cause the gripping surface to (at least partially) conform to the exterior surface of the object. Electroadhesive gripping surfaces with sufficient flexibility to conform to local non-uniformities, surface imperfections and other micro-variations and/or macro-variations in exterior surfaces of objects being adhered to are referred to herein as compliant gripping surfaces. However, it is understood that any of the gripping surfaces described herein may exhibit such compliance whether specifically referred to as compliant gripping surfaces or not.

Figure 1C:
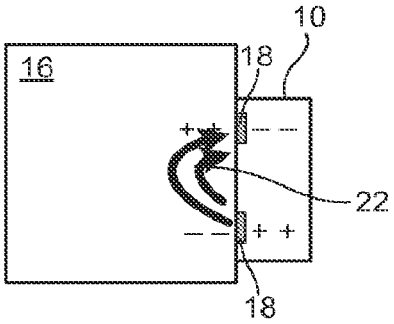
FIG. 1C illustrates in side cross-sectional close-up view an electric field formed in the foreign object of FIG. 1B as result of the voltage difference between electrodes in the adhered example electroadhesive end effector.

FIG. 1C illustrates in elevated cross-sectional close-up view an electric field formed in the foreign object of FIG. 1B as a result of the voltage difference between electrodes in the adhered example electroadhesive end effector 10. While the electroadhesive end effector 10 is placed against foreign object 14 and an electrostatic adhesion voltage is applied, an electric field 22 forms in the inner material 16 of the foreign object 14. The electric field 22 locally polarizes inner material 16 or induces direct charges on material 16 locally opposite to the charge on the electrodes of the end effector 18 and thus causes electrostatic adhesion between the electrodes 18 (and end effector 10) and the induced charges on the foreign object 16. The induced charges may be the result of a dielectric polarization or from weakly conductive materials and electrostatic induction of charge. In the event that the inner material 16 is a strong conductor, such as copper for example, the induced charges may completely cancel the electric field 22. In this case the internal electric field 22 is zero, but the induced charges nonetheless still form and provide electrostatic force to the electroadhesive end effector.

Thus, the electrostatic adhesion voltage provides an overall electrostatic force, between the electroadhesive end effector 10 and inner material 16 beneath surface 12 of foreign object 14, which electrostatic force maintains the current position of the electroadhesive end effector relative to the surface of the foreign object. The overall electrostatic force may be sufficient to overcome the gravitational pull on the foreign object 14, such that the electroadhesive end effector 10 may be used to hold the foreign object aloft. In various embodiments, a plurality of electroadhesive end effectors may be placed against foreign object 14, such that additional electrostatic forces against the object can be provided. The combination of electrostatic forces may be sufficient to lift, move, pick and place, or otherwise handle the foreign object. Electroadhesive end effector 10 may also be attached to other structures and hold these additional structures aloft, or it may be used on sloped or slippery surfaces to increase normal friction forces.

Removal of the electrostatic adhesion voltages from electrodes 18 ceases the electrostatic adhesion force between electroadhesive end effector 10 and the surface 12 of foreign object 14. Thus, when there is no electrostatic adhesion voltage between electrodes 18, electroadhesive end effector 10 can move more readily relative to surface 12. This condition allows the electroadhesive end effector 10 to move before and after an electrostatic adhesion voltage is applied. Well controlled electrical activation and de-activation enables fast adhesion and detachment, such as response times less than about 50 milliseconds, for example, while consuming relatively small amounts of power.

Electroadhesive end effector 10 includes electrodes 18 on an outside surface 11 of an insulating material 20. This embodiment is well suited for controlled attachment to insulating and weakly conductive inner materials 14 of various foreign objects 16. Other electroadhesive end effector 10 relationships between electrodes 18 and insulating materials 20 are also contemplated and suitable for use with a broader range of materials, including conductive materials. For example, a thin electrically insulating material (not shown) can be located on the surfaces of the electrodes. As will be readily appreciated, a shorter distance between surfaces 11 and 12 as well as the material properties of such an electrically insulating material results in a stronger electroadhesive attraction between the objects due to the distance dependence of the field-based induced electroadhesive forces. Accordingly, a deformable surface 11 adapted to at least partially conform to the surface 12 of the foreign object 14 can be used.

As the term is used herein, an electrostatic adhesion voltage refers to a voltage that produces a suitable electrostatic force to couple electroadhesive end effector 10 to a foreign object 14. The minimum voltage needed for electroadhesive end effector 10 will vary with a number of factors, such as: the size of electroadhesive end effector 10, the material conductivity and spacing of electrodes 18, the insulating material 20, the foreign object material 16, the presence of any disturbances to electroadhesion such as dust, other particulates or moisture, the weight of any objects being supported by the electroadhesive force, compliance of the electroadhesive device, the dielectric and resistivity properties of the foreign object, and/or the relevant gaps between electrodes and foreign object surface. In one embodiment, the electrostatic adhesion voltage includes a differential voltage between the electrodes 18 that is between about 500 volts and about 10 kilovolts. Even lower voltages may be used in micro applications. In one embodiment, the differential voltage is between about 2 kilovolts and about 5 kilovolts. Voltage for one electrode can be zero. Alternating positive and negative charges may also be applied to adjacent electrodes 18. The voltage on a single electrode may be varied in time, and in particular may be alternated between positive and negative charge so as to not develop substantial long-term charging of the foreign object. The resultant clamping forces will vary with the specifics of a particular electroadhesive end effector 10, the material it adheres to, any particulate disturbances, surface roughness, and so forth. In general, electroadhesion as described herein provides a wide range of clamping pressures, generally defined as the attractive force applied by the electroadhesive end effector divided by the area thereof in contact with the foreign object.

The actual electroadhesion forces and pressure will vary with design and a number of factors. In one embodiment, electroadhesive end effector 10 provides electroadhesive attraction pressures between about 0.7 kPa (about 0.1 psi) and about 70 kPa (about 10 psi), although other amounts and ranges are certainly possible. The amount of force needed for a particular application may be readily achieved by varying the area of the contacting surfaces, varying the applied voltage, and/or varying the distance between the electrodes and foreign object surface, although other relevant factors may also be manipulated as desired.

Because an electrostatic adhesion force is the primary force used to hold, move or otherwise manipulate a foreign object, rather than a traditional mechanical or "crushing" force, the electroadhesive end effector 10 can be used in a broader set of applications. For example, electroadhesive end effector 10 is well suited for use with rough surfaces, or surfaces with macroscopic curvature or complex shape. In one embodiment, surface 12 includes roughness greater than about 100 microns. In a specific embodiment, surface 12 includes roughness greater than about 3 millimeters. In addition, electroadhesive end effector 10 can be used on objects that are dusty or dirty, as well as objects that are fragile. Objects of varying sizes and shapes can also be handled by one or more electroadhesive end effectors, as set forth in greater detail below. Various additional details and embodiments regarding electroadhesion and applications thereof can be found at, for example, commonly owned U.S. Pat. Nos. 7,551,419 and 7,554,787, which are incorporated by reference herein in their entirety and for all purposes.

2b) Electroadhesive Gripping Surfaces

Although electroadhesive end effector 10 having electroadhesive gripping surface 11 of FIG. 1A is shown as having six electrodes 18, it will be understood that a given electroadhesive end effector or gripping surface can have just a single electrode. Furthermore, it will be readily appreciated that a given electroadhesive end effector can have a plurality of different electroadhesive gripping surfaces, with each separate electroadhesive gripping surface having at least one electrode and being adapted to be placed against or in close proximity to the foreign object to be gripped. Although the terms electroadhesive end effector, electroadhesive gripping unit and electroadhesive gripping surface are all used herein to designate electroadhesive components of interest, it will be understood that these various terms can be used interchangeably in various contexts. In particular, while a given "end effector" might comprise numerous distinct "gripping surfaces." these different gripping surfaces might also be considered separate end effectors themselves. Embodiments with multiple different gripping surfaces may be considered as one single end effector or may also be considered as numerous different end effectors acting in concert.

Figure 2A:
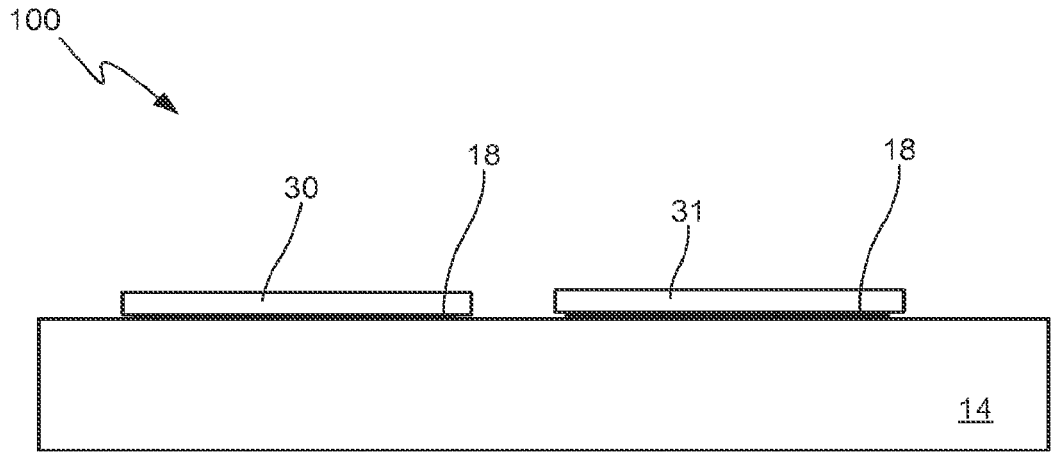
FIG. 2A illustrates in side cross-sectional view an example pair of electroadhesive gripping surfaces or end effectors having single electrodes thereon.
Figure 2B:
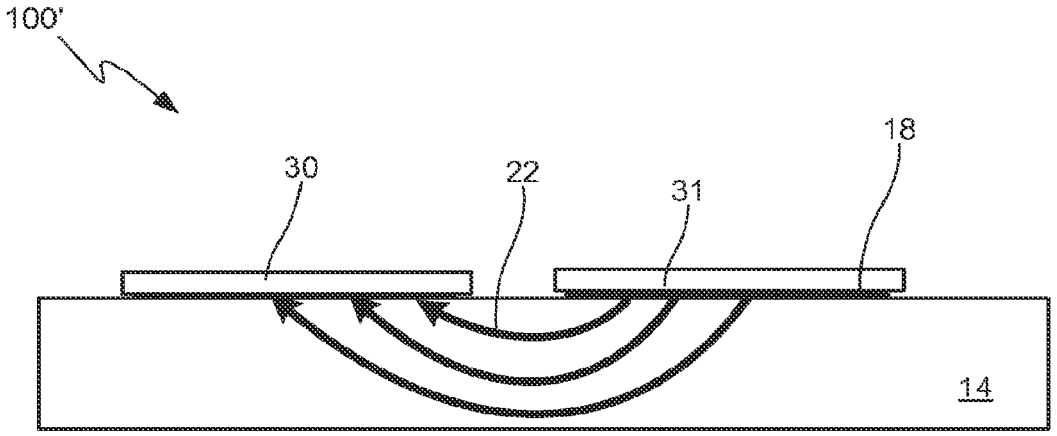
FIG. 2B illustrates in side cross-sectional view the example pair of electroadhesive gripping surfaces or end effectors of FIG. 2A with voltage applied thereto.

Referring to FIGS. 2A and 2B, an example pair of electroadhesive end effectors or gripping surfaces having single electrodes thereon is shown in side cross-sectional view. FIG. 2A depicts electroadhesive gripping system 100 having electroadhesive end effectors or gripping surfaces 30, 31 that are in contact with the surface of a foreign object 16, while FIG. 2B depicts activated electroadhesive gripping system 100' with the end effectors or gripping surfaces having voltage applied thereto. Electroadhesive gripping system 100 includes two electroadhesive end effectors or gripping surfaces 30, 31 that directly contact the foreign object 16. Each electroadhesive end effector or gripping surface 30, 31 has a single electrode 18 coupled thereto. In such cases, the electroadhesive gripping system can be designed to use the foreign object as an insulation material. When voltage is applied, an electric field 22 forms within foreign object 14, and an electrostatic force between the electroadhesive end effectors or gripping surfaces 30, 31 and the foreign object is created. Various embodiments that include numerous of these single electrode electroadhesive end effectors can be used, as will be readily appreciated.

Figure 3A:
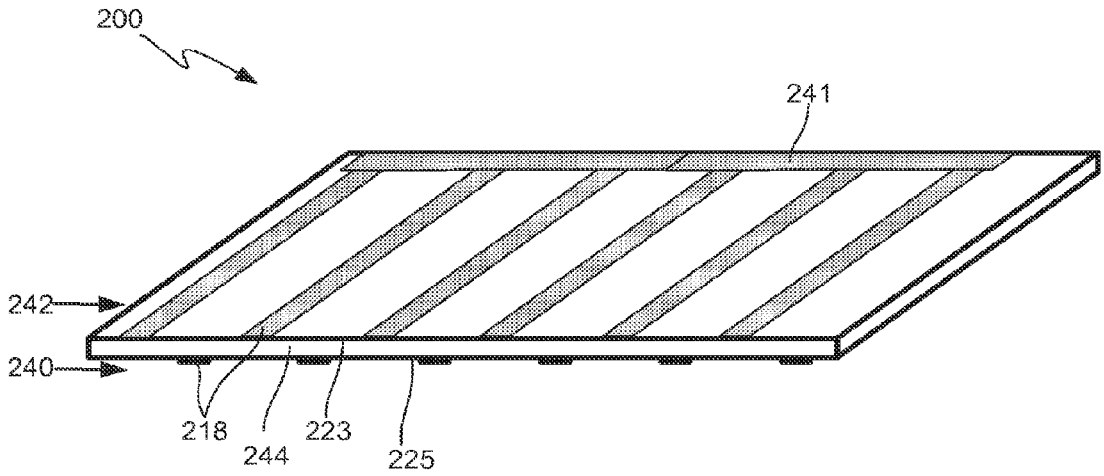
FIG. 3A illustrates in top perspective view an example electroadhesive gripping surface in the form of a sheet with electrodes patterned on top and bottom surfaces thereof.
Figure 3B:
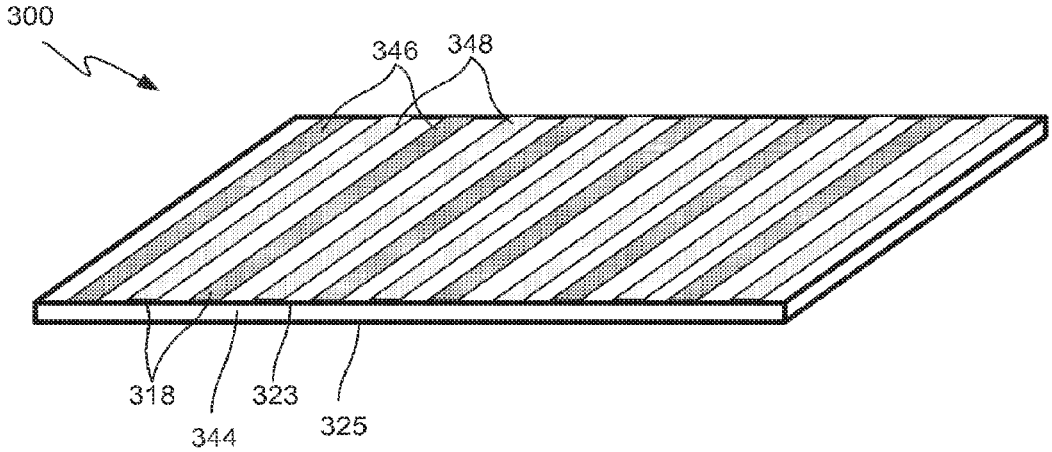
FIG. 3B illustrates in top perspective view another example electroadhesive gripping surface in the form of a sheet with electrodes patterned on a single surface thereof.

In some embodiments, an electroadhesive gripping surface can take the form of a flat panel or sheet having a plurality of electrodes thereon. In other embodiments, the gripping surface can take a fixed shape that is matched to the geometry of the foreign object most commonly lifted or handled. For example, a curved geometry can be used to match the geometry of a cylindrical paint can or soda can. The electrodes may be enhanced by various means, such as by being patterned on an adhesive device surface to improve electroadhesive performance, or by making them using soft or flexible materials to increase compliance and thus conformance to irregular surfaces on foreign objects. Turning next to FIGS. 3A and 3B, two examples of electroadhesive gripping surfaces in the form of flat panels or sheets with electrodes patterned on surfaces thereof are shown in top perspective view. FIG. 3A shows electroadhesive gripping surface 200 in the form of a sheet or flat panel with electrodes 218 patterned on top and bottom surfaces thereof. Top and bottom electrodes sets 240 and 242 are interdigitated on opposite sides of an insulating layer 244. In some cases, insulating layer 244 can be formed of a stiff or rigid material. In some cases, the electrodes as well as the insulating layer 244 may be compliant and composed of a polymer, such as an acrylic elastomer, to increase compliance. In one preferred embodiment the modulus of the polymer is below about 100 MPa and in another preferred embodiment it is more specifically below about 1 MPa. Various known types of compliant electrodes are suitable for use with the devices and techniques described herein, and examples are described in commonly owned U.S. Pat. No. 7,034,432, which is incorporated by reference herein in its entirety and for all purposes.

Electrode set 242 is disposed on a top surface 223 of insulating layer 244, and includes an array of linear patterned electrodes 218. A common electrode 241 electrically couples electrodes 218 in set 242 and permits electrical communication with all the electrodes 218 in set 242 using a single input lead to common electrode 241. Electrode set 240 is disposed on a bottom surface 225 of insulating layer 244, and includes a second array of linear patterned electrodes 218 that is laterally displaced from electrodes 218 on the top surface. Bottom electrode set 240 may also include a common electrode (not shown). Electrodes can be patterned on opposite sides of an insulating layer 244 to increase the ability of the electroadhesive end effector 200 to withstand higher voltage differences without being limited by breakdown in the air gap between the electrodes, as will be readily appreciated.

Alternatively, electrodes may also be patterned on the same surface of the insulating layer, such as that which is shown in FIG. 3B. As shown, electroadhesive gripping surface 300 comprises a sheet or flat panel with electrodes 318 patterned only on one surface thereof. Electroadhesive gripping surface 300 can be substantially similar to electroadhesive gripping surface 200 of FIG. 3A, except that electrodes sets 346 and 348 are interdigitated on the same surface 323 of a compliant insulating layer 344. No electrodes are located on the bottom surface 325 of insulating layer 344. This particular embodiment decreases the distance between the positive electrodes 318 in set 346 and negative electrodes 318 in set 348, and allows the placement of both sets of electrodes on the same surface of electroadhesive gripping surface 300. Functionally, this eliminates the spacing between the electrodes sets 346 and 348 due to insulating layer 344, as in embodiment 200. It also eliminates the gap between one set of electrodes (previously on bottom surface 125) and the foreign object surface when the top surface 323 adheres to the foreign object surface. In some cases, the electrode surface 323 may be further coated with an insulating material (not shown) so that the electrodes 346 and 348 are completely sandwiched (e.g., encapsulated) between insulating materials. Although either embodiment 200 or 300 can be used, these changes in the latter embodiment 300 provide relatively greater electroadhesive forces between electroadhesive gripping surface 300 and the subject foreign object to be handled due to the closer proximity of both sets of electrodes 346, 348 to the foreign object surface.

In some embodiments, an electroadhesive end effector or gripping surface may comprise a sheet or veil type grasper that is substantially flexible in nature. In such embodiments, either no backing structure or a substantially flexible backing structure can be used, such that all or a portion of the veil type end effector or gripping surface can substantially flex or otherwise conform to a foreign object or objects, as may be desired for a given application. Creating electroadhesive end effectors that facilitate such conforming or compliance to a foreign object can be achieved, for example, by forming the electroadhesive layer or gripping surface out of thin materials, by using foam or elastic materials, by butting out flaps or extensions from a primary electroadhesive sheet, or by applying the sheet only to a few selected underlying locations, rather than to an entire rigid backing, among other possibilities.

Although the foregoing exemplary embodiments for electroadhesive gripping surfaces in the form of flat panels or sheets depict bars or stripes for electrodes, it will be understood that any suitable pattern for electrodes could also be used for such a sheet-type electroadhesive gripping surface. For example, a sheet-type electroadhesive gripping surface could have electrodes in the form of discrete squares or circles that are distributed about the sheet and polarized in an appropriate manner, such as in an evenly spaced "polka-dot" style pattern. Other examples such as two sets of electrodes patterned as offset spirals, can also be used. As one particular example, where a thin and flexible material is used for the insulating layer, such as a polymer, and where electrodes are distributed thereabout in the form of discrete discs, a resulting flexible and compliant electroadhesive gripping surface "blanket" would be able to conform to the irregular surfaces of a relatively large object while providing numerous different and discrete electroadhesive forces thereto during voltage application.

2c) Penetration Depth Tuning

Fine control of the amount of voltage to the electrodes in a given single or set of electroadhesive end effectors can significantly affect the handling of foreign objects thereby. Varying the voltage to the electrodes results in varying the applied electrostatic or electroadhesive force between an electroadhesive end effector and an object to be handled. Such variances in the overall electroadhesive force applied to a foreign object can result in certain beneficial results, such as only a portion of the object being lifted, held or moved. A simple example of varying the amount of voltage to electroadhesive end effector electrodes to affect a result can involve flat panel or sheet-type end effectors used to pick up a stack of paper. Variances in the electroadhesive force can also be used to controllably slide objects relative to the end effector. Such controlled sliding is especially useful when repositioning objects within a grip such as repositioning a pen within a grip, or rotating a cuboid shaped object inside a robotic hand.

Figure 4A:
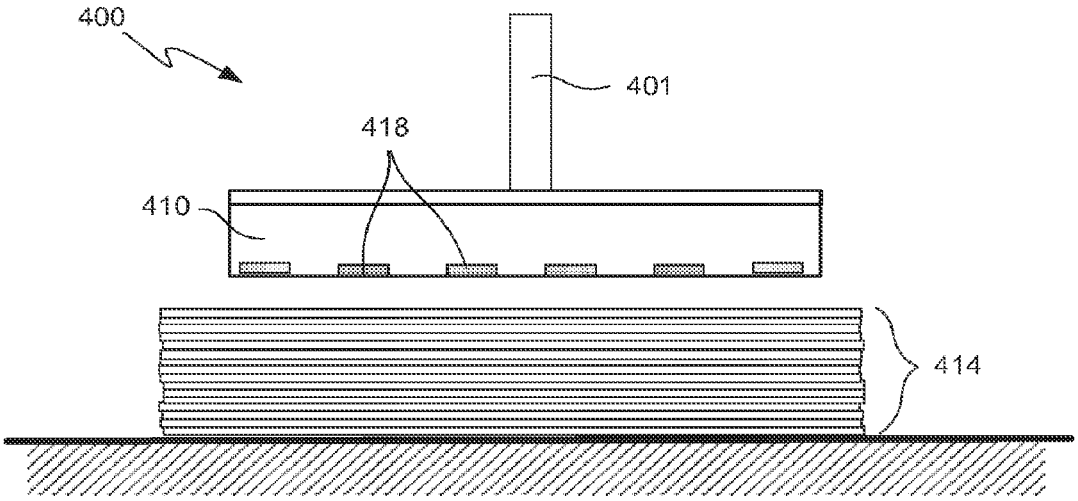
FIG. 4A illustrates in side elevated view an example flat electroadhesive end effector adapted to utilize a variable voltage.
Figure 4B:
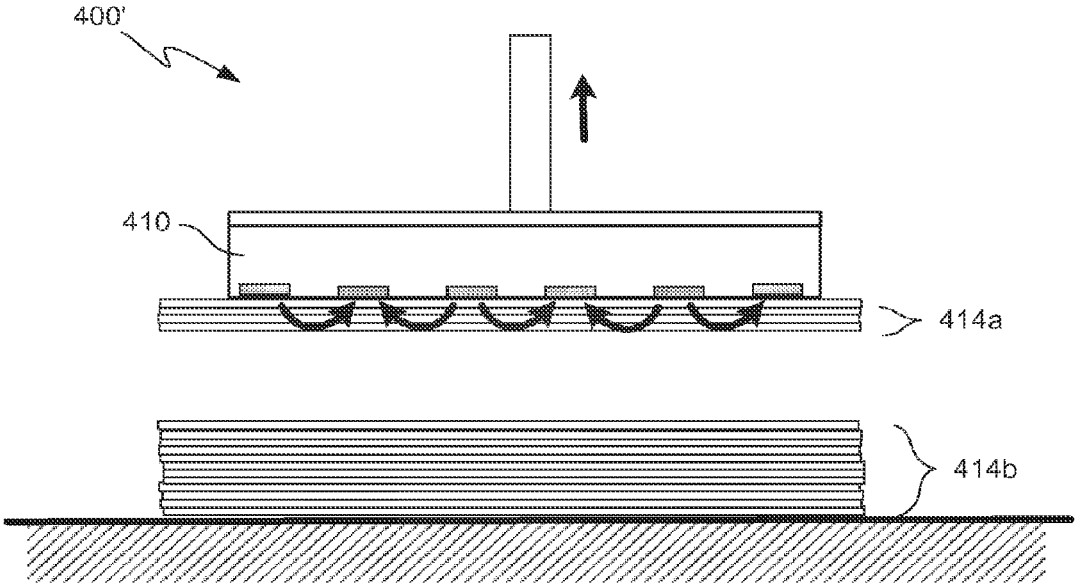
FIG. 4B illustrates in side elevated view the example electroadhesive end effector of FIG. 4A having a tuned applied voltage and picking up only a portion of a foreign object.

Continuing with FIGS. 4A and 4B, an example flat electroadhesive end effector adapted to utilize a variable voltage is illustrated in side elevated view. Electroadhesive gripping system 400 includes a flat electroadhesive end effector 410 having a plurality of electrodes 418 disposed on at least one gripping surface thereof, as well as a handle 401, bar or other tool that enables the manipulation of the end effector by a user or machine. Electroadhesive end effector 410 can include, for example, one of the flat panel or sheet-type electroadhesive gripping surfaces 200, 300 described above, although other variations for an end effector are also certainly possible. A stack of paper 414 represents the object to be handled by electroadhesive gripping system 400.

From its position in FIG. 4A, electroadhesive end effector 410 is lowered onto the stack of paper 414 and voltage is applied to the end effector. Once the appropriate level of voltage is applied and maintained, the electroadhesive end effector 410 is then lifted, as shown in modified electroadhesive gripping system 400' in FIG. 4B. Stack of paper 414 is then separated into two parts, lifted portion 414*a* and remaining portion 414*b*. As shown, lifted stack of paper 414*a* includes exactly four sheets of paper, while the remaining sheets are not lifted. The number of sheets that are lifted is dependent upon the "penetration depth" of the electroadhesive force, which is related to a number of factors.

Again, such factors can include applied voltage, the amount of surface area contacted, electroadhesive end effector size, electrode material conductivity and spacing, insulating material composition, foreign object material composition, gap distance between electrodes and the foreign object, and the presence of dust, moisture or other disturbances to electroadhesion, among others. Of all such factors though, the amount of applied voltage is one that is particularly controllable. As such, the amount of voltage that is applied to electrodes 418 can be varied or precisely "tuned" such that a desired exact number of sheets of paper are lifted.

In the example of FIGS. 4A and 4B, when no voltage is applied to the electrodes 418, then electroadhesive end effector 410 does not pick up or manipulate any of the paper stack 414. When a low voltage (V1) is applied to the electroadhesive end effector 410, then exactly one sheet of paper can be reliably picked up or moved around from the stack of paper 414. When a slightly higher voltage (V2) is applied, then exactly two sheets of paper can be similarly manipulated. When an even higher voltage is applied (V3), even more sheets can be picked up, such as the four sheets 414*a* shown in FIG. 4B. Further variations in the applied voltage can then be used to pick up different amounts of paper sheets.

Potential enhancements can include using such electroadhesion along with an active circuit that tunes the voltage, while simultaneously measuring capacitance to determine the actual number of sheets of paper that are coupled to the electroadhesive end effector. Rise time for the voltage can also be monitored as an indirect measure of capacitance, and the voltage can be tuned accordingly. Other measures to measure or quantify number of sheets lifted, such as mechanical thickness of the stack that is picked up, can also be used in a feedback loop to control the electroadhesive voltage.

Potential uses can include the handling of paper in printers, copiers, facsimile machines and the like, and even in industrial paper handling equipment, such as ATM machines or other machines handling bills or notes. Other applications can include handling sheets of laminates, such as for countertops, for example. One of skill in the art will readily appreciate the extrapolation of this concept to other more complex foreign objects, such that under one voltage an entire foreign object can be lifted, moved or otherwise manipulated, while under another lower voltage only a part or component of that foreign object is similarly moved or manipulated. Lowering the voltage in one part of a given electroadhesive gripping surface or end effector while maintaining higher voltage in another part also allows pivoting or repositioning the object within the grasp without requiring very fine control of the mechanical position and forces applied to the object.

III. Electroadhesive Gripping Applications

Some embodiments of the present disclosure utilize various electroadhesive gripping systems to manipulate objects adhered thereto. Two such electroadhesive gripping systems are an electroadhesive curtain gripper and an electroadhesive conveyor belt. The electroadhesive curtain gripper includes a conformable electroadhesive surface with flexible electrodes disposed on or within the conformable surface. When voltage is applied to the electrodes while the curtain gripper is positioned near a foreign object, the polarized conformable surface adheres to the foreign object and wraps around (conforms) to the shape of such object. The object can then be manipulated (e.g. lifted, moved, etc.) using the curtain gripper. The electroadhesive conveyor belt includes a pattern of electrodes disposed on or within a moveable surface of a conveyor. The electrodes and the rest of the belt can be configured to undergo flexion while the belt wraps around driving wheels of the conveyor system, turns around bends, and so on. The conveyor track can also include high voltage contacts that supply voltage to the electrodes within the moving belt through vias within the belt that electrically connect the embedded electrodes to the voltage supply terminals on the back side of the belt. Such vias may be spaced intermittently, such that adjacent ones of the vias each contact a given voltage supply terminal in turn. In some cases, the supply terminals on the track may be rolling contacts (e.g., wheels conductive along the outer rim) to reduce resistance between the belt and the supply terminals while the belt moves with respect to the track.

3a) Example Electroadhesive Curtain Gripper

Figure 5A:
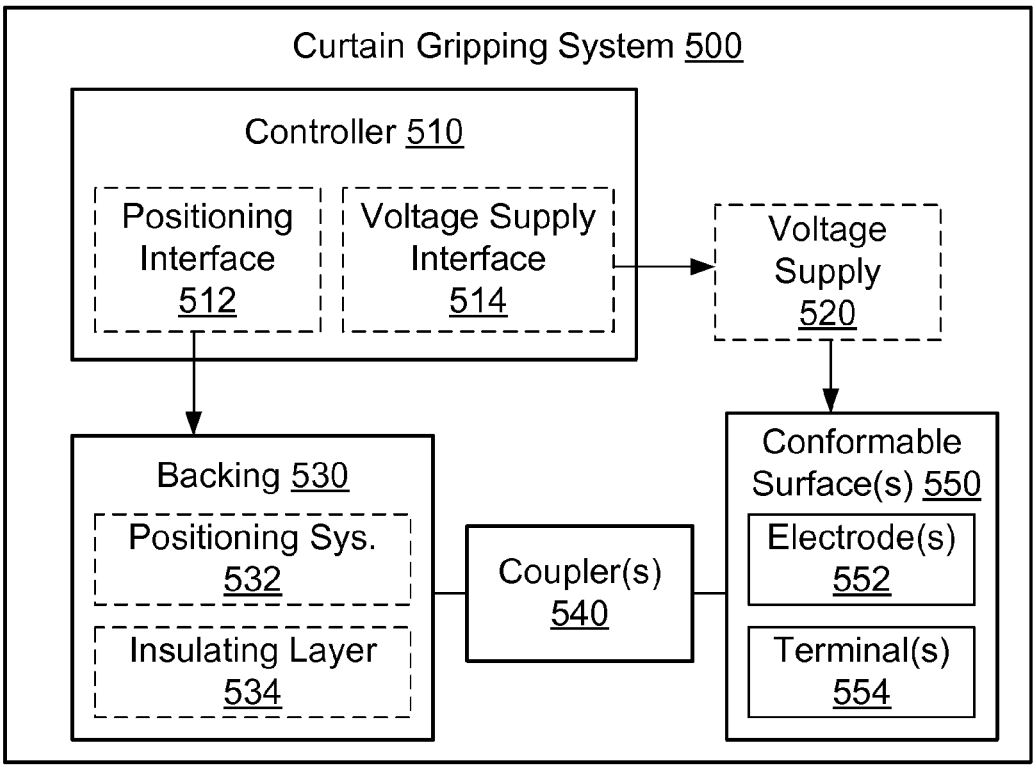
FIG. 5A is a functional block diagram of an example electroadhesive curtain gripping system.

FIG. 5A is a functional block diagram of an example electroadhesive curtain gripping system 500. The curtain gripping system includes a controller 510, a voltage supply 520, and at least one curtain gripper having an electroadhesive conformable surface 550 and a backing 530 mechanically connected by coupler(s) 540. The voltage supply 520 can be configured to supply high DC voltages in a range of, for example, 0.5 kilovolt ("kV") to about 10 kV, similar to the electroadhesion voltages discussed above in connection with FIGS. 1-4. The conformable surface 550 includes integrated electrodes 552 connected to the voltage supply 520 via respective terminals 554. The electrodes 552 can optionally be flexible electrodes, such as formed by a pattern of conductive film on a flexible substrate. The electrodes 552 can be patterned according to a variety of different geometries and are generally arranged such that opposing polarity electrodes are situated adjacent one another, and may be arranged with opposing polarity electrodes alternating one another, similar to the example electrode geometries described above in connection with FIGS. 1-4.

It is noted that the voltage supply 520 may generally be a power supply configured to output AC or DC voltages or currents sufficient to apply a polarizing voltage to the electrodes 552. For convenience in the description herein, the module 520 is therefore referred to as "voltage supply," although some embodiments may employ current supplies and/or other electrical power supplies. For example, current supplies may be tuned to provide suitable currents for generate desired polarizing voltages at the electrodes.

The conformable surface 550 of the curtain gripper can be coupled to a backing 530, which can be a semi-rigid structure used to distribute stress on the conformable surface 550 (e.g., due to a load exerted by an adhered foreign object). The backing can additionally or alternatively convey such stress forces away from the conformable surface, to a load-bearing structure such as a control arm. The couplers 540 used to mechanically connect the backing 530 to the conformable surface 550 (and thereby convey stress from the conformable surface 550 to the backing 530) may include one or more mechanical connections between the conformable surface 550 and the backing 530. In some examples, the couplers 540 allow the conformable surface 550 to have sufficient flexibility to conform to an external surface of an object being manipulated, while providing sufficient points of connection to allow local stresses on the conformable surface 550 to be transferred to the backing 530. In some examples, the couplers 540 include multiple flexible tethers, such as cables or strings, which are each attached to respective points on the conformable surface 550 and the backing 530. When pulled taught, each such flexible cable can then transmit local shear stresses on the conformable surface 550, from a region nearest the connection to the flexible cable, to a corresponding connection point on the semi-rigid backing 530. The couplers 540 may additionally or alternatively include a deformable layer connected to both the backing 530 and the conformable surface 550. Such a deformable layer may even be connected substantially continuously across the conformable surface 550. However, intermittent flexible connections (e.g., using an arrangement of multiple tethers) can allow the conformable surface 550 to more freely conform to exposed surfaces of foreign objects being manipulated, because relatively less points of the conformable surface 550 are restricted by ties to the backing 530.

The backing 530 can also include an electrical insulating layer 534. The insulating layer 534 can be situated between the electrodes 552 in the conformable surface 550 and any components in the backing 530 that may be conductive. The insulating layer 534 can thus provide an electrical buffer between the electrodes 552 to prevent discharge of the electrodes 552. The backing 530 can also include (or be connected to) a positioning system 532 for moving the conformable surface to a desired position, such as a position suited to adhere to a foreign object. The positioning system 532 may include cables or other mechanical devices to apply tension to portions of the semi-rigid backing structure so as to adjust the positions thereof. In examples in which the curtain gripping system 500 includes multiple curtain grippers (i.e., multiple conformable electroadhesive surfaces), the positioning system 532 can be used to adjust between an open position, in which multiple conformable surfaces 550 are urged apart, to a closed position, in which multiple conformable surfaces 550 are urged together, so as to surround a foreign object being gripped.

The controller 510 can include electronics and/or logic implemented as hardware and/or software modules to control operation of the curtain gripping system 500. For example, the controller 510 can include a voltage supply interface 514 for controlling the voltage supply 520 whether to apply voltage to the electrodes 552 of the conformable surface 550. The voltage supply interface 514 may be configured to operate a switch (or switches) connecting the output of the voltage supply 520 to the terminals 554 of the conformable surface 550 (or perhaps switches within the voltage supply 520). Moreover, the voltage supply interface 514 may specify a magnitude of voltage to be applied to the electrodes 552. The controller 510 may also be configured to receive inputs from sensors in order to control the voltage or current supplied to electrode 552. Such sensors may embedded into the conformable surface 550 and may utilize the electrodes 552 themselves with capacitance based sensing, or other types of sensors such as RFID, vision, X-ray, ultrasound or barcode readers. The sensors may also be located external to the device 500 and include any of the above aforementioned modalities. The voltage supply interface 514 may provide instructions to adjust the magnitude of voltage output from the voltage supply 520. Upon receiving instructions, the voltage supply 520 is configured to apply the specified voltage to conductive wires or lines connected to the terminals 554. The applied voltage can be an AC or DC voltage and/or an AC or DC current, which can provide opposing polarity on the electrodes 552 in the conformable surface and thereby cause the conformable surface 550 to induce corresponding polarization in a foreign object positioned proximate the conformable surface 550, which results in an electroadhesive attraction between the conformable surface 550 and the foreign object. Using the voltage supply interface 514 to cause the voltage supply 520 to apply voltage to the terminals 554 can thus be considered turning on the electroadhesive curtain gripper 500. Similarly, causing the voltage to cease being applied to the terminals 554 (e.g., by turning off or disconnecting the voltage supply 520, or reducing the magnitude of the applied voltage, etc.) can be considered turning off the electroadhesive curtain gripper 500.

The controller 510 may also include a positioning interface 512 configured to control the position of the curtain gripper 550. For example, the controller 510 can instruct one or more position motors (e.g., servo motors or the like) in the positioning system 532 to adjust the position of the backing, which thereby adjusts the position of the conformable surface 550, via the couplers 540.

Figure 5B:
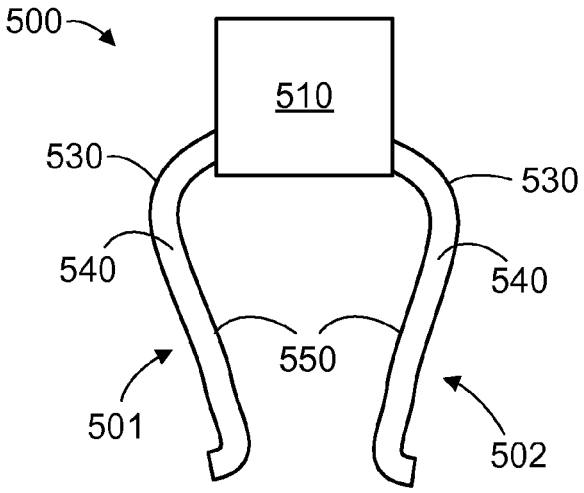
FIG. 5B is a simplified diagram of an example embodiment of the curtain gripping system.

FIG. 5B is a simplified diagram of an example embodiment of the curtain gripping system 500. A first curtain gripper 501 and a second curtain gripper 502 are attached to a controller 510. Each of the curtain grippers 501, 502 include a conformable electroadhesive surface 550 connected to a backing 530 by one or more couplers 540. The curtain grippers 501, 502 are situated such that the respective electroadhesive surfaces 550 face one another, such that the two conformable surfaces 550 can simultaneously adhere to a foreign object situated between the two curtain grippers 501, 502. The controller 510 may optionally include the voltage supply 520, or otherwise communicate with a voltage supply that is connected to apply voltage to electrodes in the conformable surfaces 550 of the curtain grippers 501, 502.

When positioned proximate a foreign object (e.g., via the positioning system 532), opposing polarity voltages can be applied to the electrodes 552 sufficient to induce a complementary local electrical polarization in the foreign object. The resulting electroadhesive attraction between the foreign object and the conformable surface 550 of the curtain gripper may cause the conformable surface 550 to wrap around (i.e., conform to) the foreign object. While the voltage is applied to the electrodes 552, the curtain gripper can then be used to lift, drag, move, position, place, or otherwise manipulate the foreign object. For example, the foreign object can be manipulated by pulling on the end of the conformable surface 550 that is not adhered to the foreign object. In some examples, the curtain gripper system 500 can be attached to a control arm, which can then be used to move the adhered foreign object to a desired position. Once moved/positioned to a desired location, the foreign object can then be released by reducing the voltage applied to the electrodes 552 (e.g., turning the voltage off).

3b) Example Electroadhesive Conveyor Belt

Figure 6A:
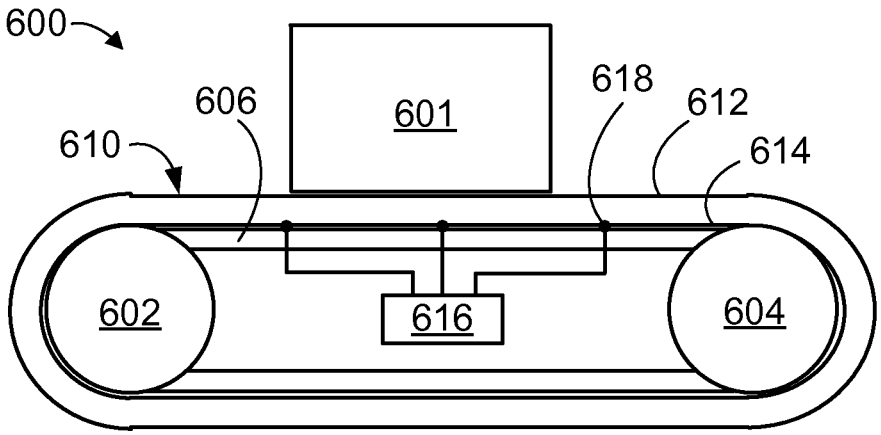
FIG. 6A illustrates a side view of an electroadhesive conveyor system.

FIG. 6A illustrates a side view of an electroadhesive conveyor system 600. The conveyor system 600 includes a conveyor belt 610 that wraps around two pulleys 602, 604 and a track 606, in a continuous loop of material. The pulleys 602, 604 can rotate to cause the belt 610 to move along the track 606. For example, the pulleys 602, 604 can be connected to a driving system which rotates an axle of one or both pulleys 602, 604 to cause the pulleys 602, 604 to rotate in a desired direction and/or speed. The pulleys 602, 604 interface with an inner surface 614 of the belt 610 to thereby urge the belt 610 to move along the track 606. To facilitate frictional interaction between the inner surface 614 and the pulleys 602, 604, the belt length and/or pulley position(s) can be selected such that the belt 610 is pulled taught across the pulleys, which can thus decrease slippage between the belt 610 and the pulleys 602, 604. When in motion, an outer surface 612 of the belt 610 can be used to convey item(s) resting thereon along a path defined by the belt 610. As shown in FIG. 6A, an item to be conveyed 601 rests on the outer surface 612 of the belt 610. The item 601 can be a box, package, parcel, container, etc., such as those encountered in warehousing and/or package handling facilities, for example. The track 606 may include idler rollers that roll freely, for example, to allow the belt 610 to move along the track 606 with relatively low resistance. Additionally or alternatively, driven rollers may be included along the track 606 to be used in urging the belt 610 along the track 606.

When the belt 610 is driven by the pulleys 602, 604, the outer surface 612 of the belt 610 translates along the track 606 to thereby convey the item 601 along a path defined by the belt 610. Absent slippage, the rotational motion of the pulleys 602, 604 can thus be used to convey the object 601 on the outer surface 612 of the belt 610. However, the operation of the conveyor system 600 to convey the item 601 is generally limited by frictional forces between the item 601 and the outer surface 612 of the belt 610. Particularly in scenarios in which the belt 610 is used to accelerate the item 601 (e.g., to turn around a corner, to move along an incline, to speed up and/or slow down, etc.), the item 601 slips off of the belt 610 in the absence of sufficient frictional attraction between the belt 610 and the item 601. Some embodiments of the present disclosure therefore provide for using electroadhesion to secure items (e.g., the box 601) being conveyed on the conveyor belt 610.

Figure 6B:
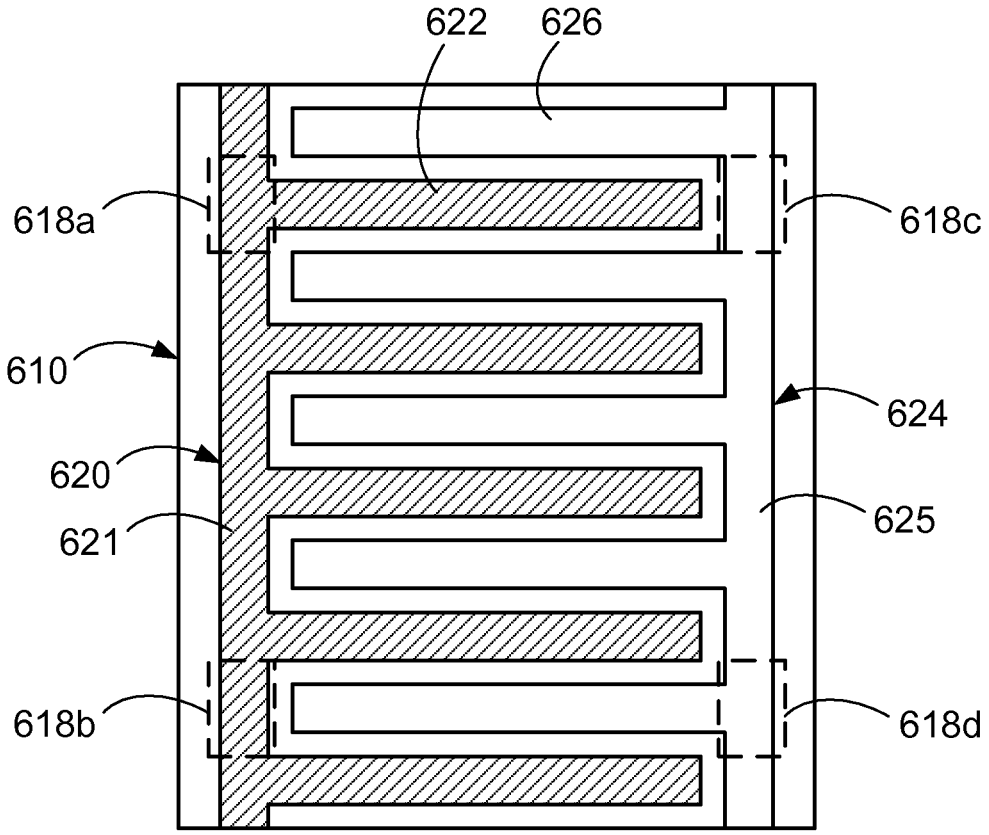
FIG. 6B illustrates a top view of the electroadhesive conveyor belt with electrodes exposed for view.

The belt 610 can thus include one or more electrodes disposed on or within the belt 610 to induce an electroadhesive attraction between the belt 610 and item(s) being conveyed by the belt 610. FIG. 6B illustrates a top view of the electroadhesive conveyor belt 610 with electrodes 620, 624 exposed for view. The electrodes 620, 624 can be embedded between insulating outer and inner layers (632, 634 in FIGS. 6C-6E) forming the outer and inner surfaces 612, 614, respectively. For example, the outer layer can be formed of a polymeric material and/or other flexible materials with suitable tensile strength to be circulated around the pulleys 602, 604 while under tension. The outer layer may include, for example, a rubberized surface that interfaces with the item 601 placed thereon via frictional forces. Moreover, such inner and outer layers may protect the electrodes 620, 624 from mechanical disruption (e.g., a puncture, tear, etc.) and also prevent discharge of the electrodes 620, 624 via direct contact between the electrodes 620, 624 and any conductive materials placed on the belt 610.

Figure 6C:
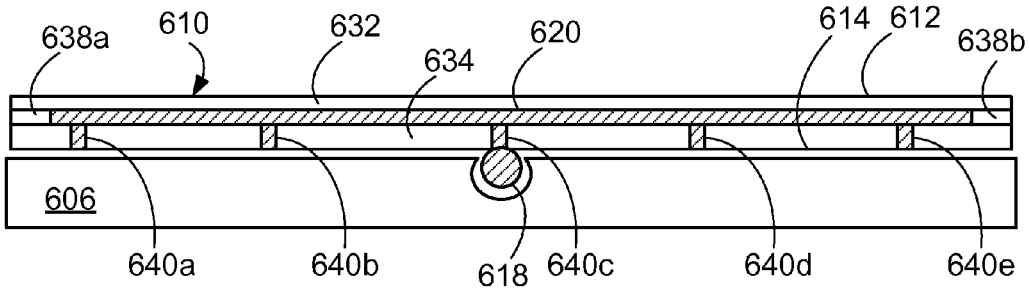
FIG. 6C illustrates a side cross-section of an electroadhesive belt with an electrode disposed therein that is non-continuously connected along the length of the belt.
Figure 6D:
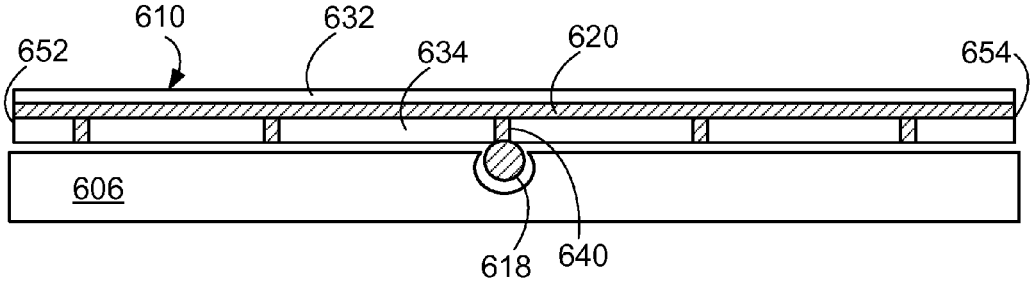
FIG. 6D illustrates a side cross-section of an electroadhesive belt with an electrode disposed therein that is continuously connected along the length of the belt.
Figure 6E:
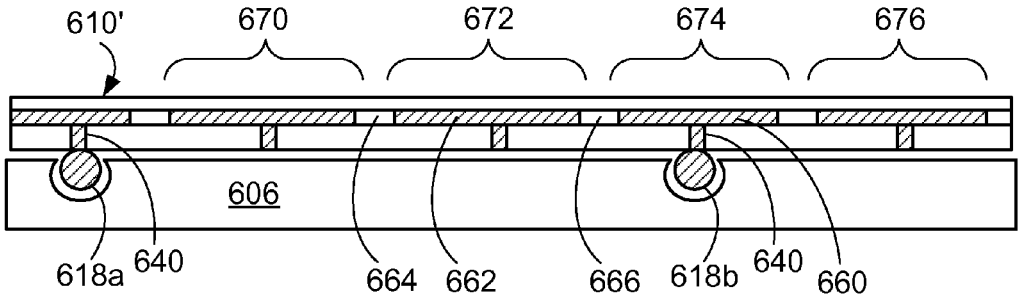
FIG. 6E illustrates a side cross-section of an electroadhesive belt with segmented, separately addressable electrodes disposed therein.

The electrically insulating inner and outer layers of the belt 610 (which layers are also shown in FIGS. 6C-6E) can thus combine to substantially encapsulate the electrodes 620, 624. However, electrical connection between the electrodes 620, 624 and a suitable voltage supply is necessary in order to apply a polarizing voltage to the electrodes, which then induces an electroadhesive response in the item 601. Some embodiments of the present disclosure therefore provide for rolling high voltage contacts 618 that connect to terminals on the inner surface 614 of the belt 610. The terminals along the inner surface 614 connect to the electrodes 620, 624 through conductive vias that pass through the inner insulating protective layer. The rolling electrical contacts 618 can be implemented as a rolling cylinder or wheel with an electrically conductive outer wall. The outer wall of the rolling contact 618 receives voltage from a high voltage supply (e.g., conveyed through an axle, slip ring, and/or sliding contact(s) to charge the outer edge of the rolling contact 618). Additionally or alternatively, high voltage supplied to the conductive outer wall of the rolling contacts 618 can be generated inside the rolling cylinder itself. For example, the cylinder can house voltage conversion electronics (e.g., transformers, diodes, etc.) that generate an appropriate high voltage output from a low voltage conveyed through an axle, slip ring, and/or sliding contact (s).

The rolling contacts 618 can rotate on axles at fixed locations along the track 606. The rolling contacts 618 can thus be similar to an idle roller used to facilitate transport of the belt 610 along the track 606, except that the outer edges of the rolling contacts 618, which contact the inner surface 614 of the belt, can be charged to a voltage. As the belt 610 moves over the rolling contacts 618, the rolling contacts 618 connect to new positions along the inner surface 614 of the belt 610. As noted above, the inner surface 614 includes an arrangement of terminals positioned to meet the rolling contacts 618 as the belt 610 moves. Upon contact with a terminal, a given one of the rolling contacts 618 applies a voltage to the electrode 620 connected to the terminal, through a conductive via (640 in FIGS. 6C-6E). In other words, the terminals along the inner surface 614 (and corresponding vias) connect the voltage from the rolling contacts 618 to the electrodes 620, 624 within the belt 610. Such terminals (and corresponding vias) can be spaced intermittently along the length of the belt 610, such that adjacent ones of the terminals contact a given rolling contact 618 in series as the belt moves 610 along the track 606.

A controller 616 can control the voltage applied to the rolling contacts 618 (e.g., by controlling a high voltage supply, similar to the controller 510 in the curtain gripping system 500). The controller 616 may therefore be connected to the rolling contacts 618 or may control (e.g., regulate) an electrical connection between a high voltage supply and the rolling contacts 618. It is noted that the voltage supply controlled by the controller 510 may generally be a power supply configured to output AC or DC voltages or currents sufficient to apply a polarizing voltage to the rolling contacts 618. Further, the AC or DC voltage or current conveyed to the rolling contacts 618 may be converted to a suitable high voltage suitable for electroadhesion by electronics within the rolling contacts 618. Moreover, the controller 616, which can include a combination of hardware and/or software implemented modules configured to carry out various processes described herein, can also control operation of the conveyor driving system (e.g., the driving system for the pulleys 602, 604). Thus, in some examples, the controller 616 can operate to control both the movement of the belt 610 (e.g., by causing the pulleys 602, 604 to rotate) and the electroadhesive force between the conveyed item 601 and the belt 610 (e.g., by applying voltage to the rolling contacts 618).

As shown in FIG. 6B, the pattern of electrodes within the belt 600 can include a first electrode 620 and a second electrode 624. For example, the first electrode 620 can be configured to be charged to a positive voltage relative to the second electrode 624. For convenience in notation and explanation only, the first electrode is alternately described herein as a positive electrode, and is illustrated with a cross-hatching to allow the first electrode to be readily distinguished from the second electrode, which is shown without cross-hatching. Similarly, the second electrode is alternately referred to as a negative electrode. Referring again to FIG. 6B, the first electrode 620 can include a lengthwise side rail 621 that extends along the length of the belt 610, and can be substantially parallel to one side of the belt 610. The second electrode 624 can include a lengthwise side rail 625 that extends along the length of the belt 610, and can be substantially parallel to another side of the belt 610.

The electrodes 620, 624 can also include an arrangement of interdigitated alternating electrodes 622, 626, which can extend from the respective side rails 621, 625. The interdigitated electrodes are situated such that opposite polarity electrodes are adjacent one another, in an alternating fashion. The interdigitated electrodes 622, 626 can extend within the belt at least partially transverse to the respective side rails 621, 625 (e.g., across the width of the belt, rather than the length). As such, the center portion of the belt 610 can include the alternating electrodes 622, 626 and the regions near the opposite side edges can include the two side rails 621, 625. The two regions near the side edges thus form a substantially continuous strip of the belt 610 that are associated with a given one of the opposite polarity voltages (rather than both).

In some embodiments, given ones of the rolling contacts 618 can be associated with a given one of the opposite polarity voltages used to polarize the electrodes 620, 624. The rolling contacts 618 can therefore be positioned to overlap the regions of the belt 610 including the respective side rails 621, 625. For example, the two rolling contacts 618*a*, 618*b* can each be charged with a positive voltage and be situated along the track 606 at a location beneath the side rail 621 for the positive electrode 620. Similarly, the two rolling contacts 618*c*, 618*d* can each be charged with a negative voltage and be situated along the track 606 at a location beneath the side rail 625 for the negative electrode 624. Conductive vias can extend from the side rails 621, 625, through an inner protective layer of the belt 610, to corresponding terminals along the inner surface 614 of the belt 610. As the belt 610 rolls along the rolling contacts 618, the terminals contact the rolling contact 618 to apply the positive/negative voltages to the positive/negative electrodes 620, 624, through the vias.

When the polarizing voltages are applied to the terminals 620, 624 within the belt 610, the item 601 has induced an induced electroadhesive response, which attracts the item 601 to the belt 610. The force holding the item 601 to the belt 610 is thereby increased (e.g., the induced electroadhesive force supplements the friction interaction between the outer surface 612 of the belt 610 and the outer surface of the item 601. The increased holding force between the item 601 and the belt 610 allows the conveyor system 600 to be operated at increased speeds and/or accelerations, without the item 601 slipping off of the outer surface 614.

FIG. 6C illustrates a side cross-section of an electroadhesive belt with an electrode disposed therein that is non-continuously connected along the length of the belt 610. The electrode 620 is situated between an outer layer 632, which forms the outer surface 612, and an inner layer 634, which forms the inner surface 614. A series of vias 640*a-e* electrically connect the electrode 620 to the inner surface 614, and thereby connect the electrode 620 to the rolling connector 618 (e.g., through the via 640*c*). As the belt 610 moves along the rail 606, another one of the vias contacts the rolling connector (e.g., the via 640*b* or 640*d*, depending on direction of belt motion).

In between each connection with the rolling contact, the electrodes substantially maintain the voltages via the internal capacitance in the pattern of electrodes. In some examples, the separation distance between adjacent ones of the vias 640*a-e* can be selected based on factors including belt speed, spacing between the rolling contacts 618, ability to cut the belt and then make a seam to make arbitrary overall belt lengths, and capacitance of the electrode pattern, such that the amount of variation in the polarization voltage between intermittent contacts is within a target range. During operation, the polarization voltage varies due to alternating between discharge while the electrode 620 is disconnected from any of the rolling contacts 618 (while the rolling contact 618 is between vias 640) and charging while the electrode 620 is connected to at least one of the rolling contacts 618. Moreover, the surface area of conductive terminals along the inner surface 614 that are associated with each via 640 can be adjusted (e.g., increased) to allow for longer duration and/or greater frequency connections between the electrode 620 and the rolling connectors 618.

Once assembled, the belt 610 can be formed in a single continuous loop of material that stretches over the pulleys 602, 604. However, during manufacture, the belt 610 may be first assembled as a laminated sheet with the embedded electrodes 620, 624 between the inner and outer layers 632, 634. In other embodiments, the laminated sheet may include its own insulating layer on top of the electrodes that is distinct from the belt outer layer 632. In yet other embodiments, the electrodes may be deposited directly onto the belt inner material 634 through a variety of coating or deposition processes such as screen printing, spraying, laminating or etching, with no separate layer necessary. The belt is then joined together to create a loop. However, joining procedures may not allow for creating an electrical connection between the two ends that are joined. As such, the ends of the belt 610 may commence and terminate with portions 638*a*, 638*b* that do not include the conductive electrode 620. An alternative filler material may be inserted in the portions 638, 638*b*, for example. The respective ends of the belt 610 can then be joined together (e.g., by stitching, fusing, bonding, etc.). The region surrounding the junction is non-electroadhesive due to the interruption of the electrode 610, although such interruption may be confined to a short length of the belt 610, relative to its total length. The resulting electrode 620 may therefore be non-continuously connected along the length of the belt 610.

FIG. 6D illustrates a side cross-section of an electroadhesive belt with an electrode 620 disposed therein that is continuously connected along the length of the belt 610. The laminated sheet used to assemble the belt 610 is constructed with embedded electrodes all the way to the edges of the belt 610. During assembly of the belt 610, the two ends 652, 654 are mechanically joined together, and the two exposed ends of the electrodes are joined electrically as well. For example, the exposed ends of the electrode 620 may be joined by a welding, fusing, and/or annealing process, and/or an electrically conductive material may be used such as solder or a conductive adhesive or gel, or the like. Once the resulting belt 610 is assembled, the electrode 620 can be continuously electrically connected along the entire length of the belt 610.

FIG. 6E illustrates a side cross-section of an electroadhesive belt 610' with segmented, separately addressable electrodes disposed therein. Rather than a single continuous strip, electrodes embedded between the outer and inner layers 632, 634 have a length that only spans a subsection of the total length of the belt 610. As shown in FIG. 6E, the addressable belt 610' can include a first section 670, a second section 672, a third section 674, and a fourth section 676. Each of the section 670-676 can include a distinct electrode (e.g., the electrodes 660, 662) that are not connected to electrodes in adjacent sections. The distinct electrodes in each subsection are each connected to at least one via 640 to connect the respective electrode to a nearest rolling connector 618. As such, the particular subsections 670-676 only have voltage applied (i.e., are only turned on) while the particular subsection passes over a rolling connector 618, which then polarizes the electrodes within the particular subsection. Adjacent subsections can be separated from one another by non-conductive regions to electrically isolate electrodes in adjacent subsections from one another. For example, the non-conductive regions 664, 666 on either side of the electrode 662 of the second subsection 672.

This arrangement can thus be used to allow particular subsections of the addressable belt 610' to exhibit electroadhesive effects on items within the subsection, while other subsections at different areas along the length of the belt 610' do not exhibit electroadhesive attraction. Moreover the electroadhesive effect can be turned on/off (or otherwise tuned) based on the position of a particular subsection 670-676 on the track 606. This is because the electroadhesive attraction by each subsection 670-676 is activated by applying voltage from rolling connectors 618 that remain in a fixed position along the track 606. For example, voltage can be applied to rolling connectors at one portion of the track 606 while no voltage can be applied to rolling connectors at another portion of the track 606. A given subsection of the belt 610' is thus turned on upon a via 640 for the given subsection making contact with the rolling connector 618 charged with a supply voltage. The given subsection can then discharge, and cease electroadhesion, once the subsection is no longer in range of the charged rolling connector 618. Further still, discharging connectors may be included along the path 618 to allow a given subsection to discharge more rapidly (i.e., to discharge the voltage on the internal capacitance of the pattern of electrodes).

The sequence of charging (and associated electroadhesive attraction) followed by discharging (and associated electroadhesive disconnection) is then repeated by each subsection reaching the particular rolling connectors. In continuous operation then, the combined effect is that the belt 610' exhibits electroadhesive attraction along regions of the track 606 with charged rolling connectors 618, and does not exhibit electroadhesive attraction along regions of the track 606 without such connectors (or with discharged connectors). Moreover, by adjusting the voltages applied by various ones of the rolling connectors, the magnitude of electroadhesive attraction can be adjusted at various positions along the track 606. Further still, the voltages (and associated electroadhesive effects) at various positions can be dynamically adjusted in real time to cause the track to exhibit a desired amount of position-dependent electroadhesion. For example, the controller 616 may adjust the voltages supplied by each of the rolling connectors 618 on the basis of a variety of factors to either apply additional electroadhesive attraction (e.g., to ensure a particular item does not detach from the belt 610') and/or to apply reduced electroadhesive attraction (e.g., to allow a particular item to slide off of the belt 610').

IV. Material-Selective Electroadhesion

Some embodiments of the present disclosure find application in material handling and sorting. For example, electroadhesive grippers may be arranged with material-selective electroadhesive properties. In some examples, material-selective electrode patterns can be used to cause a gripper to adhere to articles formed substantially of a particular material without adhering to articles formed substantially of another material. In some examples, material-selective voltages can be used to cause a gripper to adhere to articles formed substantially of a particular material without adhering to articles formed substantially of another material. The material-selective responsiveness of a particular gripper can therefore depend on a combination of the voltage applied to the grippers electrodes, and the arrangement of those grippers. Generally, the electroadhesive interaction with a particular material may also depend on the susceptibility of the material to generate an induced electroadhesion by local electrical polarization (e.g., the conductivity of the particular material) as well as the weight and/or density of the article being manipulated, among other factors. Such a material-selective electroadhesive gripper can thus be used to separate articles formed of the particular material (or including the particular material) from an intermixed group of articles. Examples of material-selective grippers are included herein.

4a) Voltage Dependence

By adjusting the voltage magnitude applied to electrodes in a particular gripper, the induced electroadhesive force can be adjusted to cause the gripper to adhere to some materials without adhering to others. Materials with relatively high conductivity adhere more readily at lower voltages, because they are relatively more susceptible to developing an induced electroadhesive effect due to greater charge transport in such materials. On the other hand, materials with relatively low conductivity require higher voltages in order to adhere to an electroadhesive gripper, because a greater applied polarization voltage is required to induce an electroadhesive effect in less conductive materials. As such, electroadhesive grippers having a relatively low or intermediate voltage (e.g., a voltage sufficient to adhere to high conductivity materials without adhering to low conductivity materials) can be used to adhere to high conductivity materials without also adhering to low conductivity materials. Such a material-selective gripper can then be used to separate the adhered materials from those that are not, such as by moving the electroadhesive gripper, and thereby carrying away only those materials adhered to the gripper. It is recognized that generating a sufficient electroadhesive force to lift or otherwise manipulate a particular object may depend on other factors in addition to material composition, such as the object's weight, density, surface friction, etc., as well as the electrode geometry and other factors related to the gripper itself, some examples of material-selective voltages for a curtain gripping system are described below.

Figure 7C:
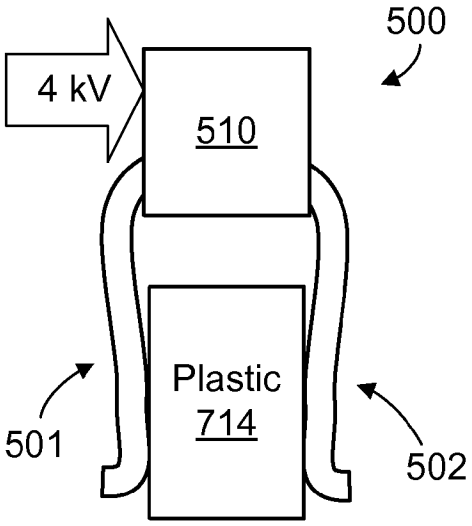
FIG. 7C illustrates an electroadhesive gripper attracted to a plastic material when a third voltage is applied.
Figure 7B:
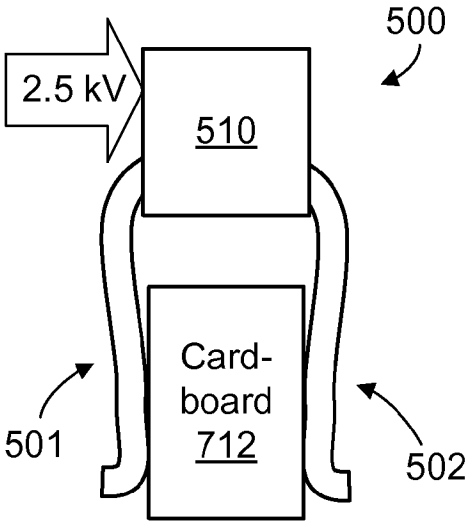
FIG. 7B illustrates an electroadhesive gripper attracted to a cardboard material when a second voltage is applied.
Figure 7A:
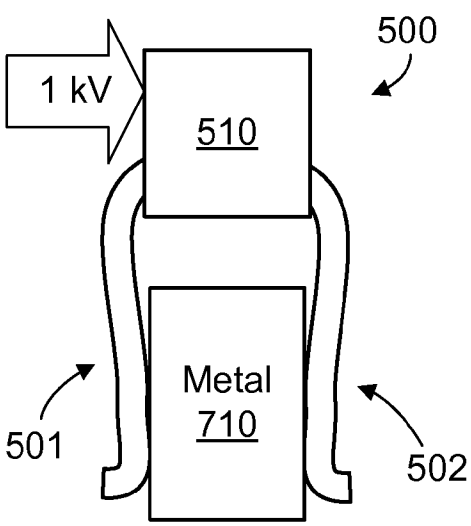
FIG. 7A illustrates an electroadhesive gripper attracted to an aluminum material when a first voltage is applied.

FIG. 7A illustrates an electroadhesive gripper 501 attracted to a metal article 710 when a first voltage is applied. The electroadhesive gripper 601 can have a pair of curtain grippers 501, 502. The metal article 710 could be, for example, an aluminum can. In other examples, the metal article 710 may be another metal such as tin, steel, etc. In addition, the metal article 710 can have a non-cylindrical shape, because the curtain grippers 501, 502 can generally conform to a variety of external surfaces of metal objects to facilitate an electroadhesive attraction. The controller 510 can instruct a 1 kV voltage to be applied to the electrodes in the conformable surfaces of the two curtain grippers 501, 502. When the respective electrodes in the curtain grippers 501, 502 are polarized at 1 kV, the two curtain grippers 501, 502 adhere to the sidewalls of the metal article 710 and thereby allow the metal article 710 to be manipulated. For example, the controller 510 may be included in, or manipulated by, a control arm or other lifting device. Since the controller 510 is connected to the two curtain grippers 501, 502, moving the controller 510 also manipulates the metal article 710 adhered to the grippers 501, 502. In an example, a pair of curtain grippers polarized with a 1 kV voltage can adhere to sidewalls of an aluminum can, such as may be used for food storage.

FIG. 7B illustrates an electroadhesive gripper attracted to a cardboard article 712 when a second voltage is applied. At 1 kV, the curtain grippers 501, 502 may not generate sufficient electroadhesive attraction to enable manipulation of the cardboard article 712. To adhere to a cardboard material (or another paper fiber based material), the controller 510 can instruct a 2.5 kV voltage to be applied to the electrodes in the conformable surfaces of the two curtain grippers 501, 502. When the respective electrodes in the curtain grippers 501, 502 are polarized at 2.5 kV, the two curtain grippers 501, 502 may adhere to the sidewalls of the cardboard article 712 and thereby allow the cardboard article 712 to be manipulated. For example, the controller 510 may be included in, or manipulated by, a control arm or other lifting device. In an example, a pair of curtain grippers polarized with a 2.5 kV voltage can adhere to the sidewalls of a cardboard tube, such as may be encountered in consumer packaging materials for dispensing rolls of aluminum foil, paper towels, etc. Articles made of other paper fiber based materials may be adhered in a similar manner as cardboard article 712 may be another paper fiber based material. Moreover, the cardboard article 712 may be non-cylindrical (e.g., a cardboard box, etc.), because the curtain grippers 501, 502 can generally conform to a variety of external surfaces of cardboard objects to facilitate an electroadhesive attraction.

FIG. 7C illustrates an electroadhesive gripper attracted to a plastic article 714 when a third voltage is applied. At 1 kV and 2.5 kV, the curtain grippers 501, 502 may not generate sufficient electroadhesive attraction to enable manipulation of the plastic article 714. To adhere to the plastic article 714, the controller 510 can instruct a 4 kV voltage to be applied to the electrodes in the conformable surfaces of the two curtain grippers 501, 502. When the respective electrodes in the curtain grippers 501, 502 are polarized at 4 kV, the two curtain grippers 501, 502 may adhere to the sidewalls of the plastic article 714 and thereby allow the plastic article 714 to be manipulated. For example, the controller 510 may be included in, or manipulated by, a control arm or other lifting device. In an example, a pair of curtain grippers polarized with a 4 kV voltage can adhere to sidewalls of a plastic bottle, such as may be encountered in containers for beverages and other liquids. In other examples, the plastic article 714 may be another polymeric material, including commonly recyclable plastic materials. Moreover, the plastic article 714 may be non-cylindrical (e.g., a box, etc.), because the curtain grippers 501, 502 can generally conform to a variety of external surfaces of plastic objects to facilitate an electroadhesive attraction.

Furthermore, it is noted that the specific 1 kV, 2.5 kV, and 4 kV polarization voltages are disclosed in connection with lifting various articles made of metal, cardboard, and plastic by way of example and explanation and not limitation. It is recognized that specific polarization voltages required to adhere to specific materials may be influenced by the weight and/or density of the object (e.g., container objects that are full or empty), the particular arrangement of curtain grippers (e.g., total surface area of the foreign object conformally covered by electroadhesive curtain grippers), coatings on the object (e.g., paper and/or polymeric film wrappers) and so on.

The voltage-dependent material-specific electroadhesion described above for FIGS. 7A-7C can be used for sorting applications, for example, for sorting recyclable materials. In one such example, a group of objects including an assortment of articles composed of metal, glass, plastic, paper, and so on may be intermixed. To facilitate further processing, such as for recycling the intermixed objects can be sorted based on material composition. One such sorting routine involves removing high conductivity articles (e.g., metal objects) from the intermixed group using an electroadhesive gripper operating at a relatively low voltage to adhere to such materials without adhering to others (e.g., 1 kV). Next, intermediate conductivity materials (e.g., cardboard) can be removed from among the remaining objects using an electroadhesive gripper operating an intermediate voltage (e.g., 2.5 kV). Even less conductive materials (e.g., plastic or glass) can then be removed from materials still left using a higher voltage (e.g., 4 kV). A still higher voltage can be used to adhere to even less conductive materials and/or any remaining materials (e.g., non-conductive materials) can be handled without electroadhesion (e.g., by a conveyor belt). The number of voltage steps, and individual passes over electroadhesive grippers operating at those voltages can depend on the number of gradations of a particular sorting routine. Examples of such systems are provided, for example, in FIGS. 8A and 8B, and the descriptions thereof.

4b) Electrode Geometry Dependence

By adjusting the spatial frequency of electrodes in a particular gripper, the penetration depth of the electroadhesive force can be adjusted to cause the gripper to adhere to some materials without adhering to others. Materials with relatively high conductivity adhere more readily to grippers with simple, low spatial frequency electrode patterns. For example, a pattern with just two electrodes: one positive, one negative, may be used to induce an electroadhesion response in a high conductivity material. On the other hand, materials with relatively low conductivity require more densely interdigitated, high spatial frequency electrode patterns to adhere to an electroadhesive gripper. Low conductivity materials are less susceptible to transporting charges across distances, and so local polarization effects (and the resulting electroadhesion response) are more effective over relatively short distances.

Figure 8A:
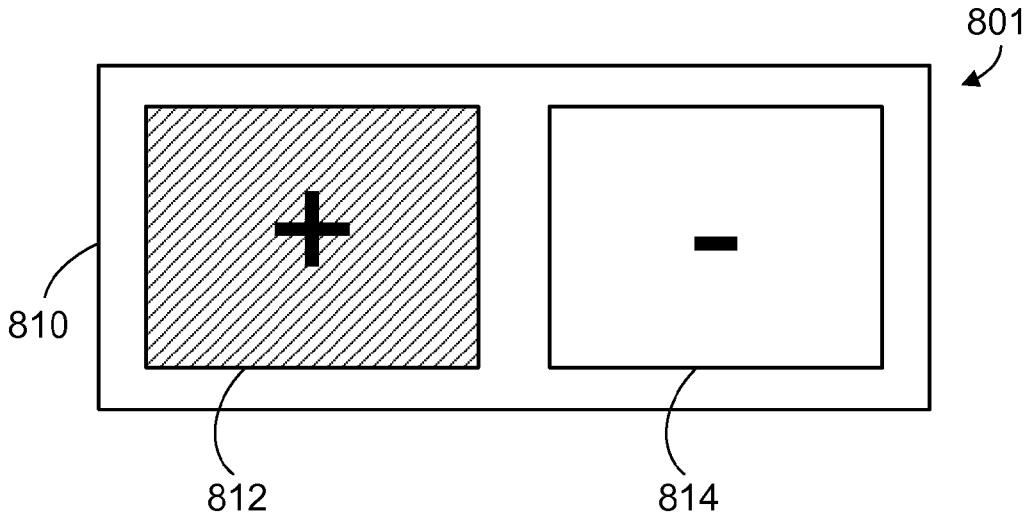
FIG. 8A illustrates a gripper with a broad electrode pattern for adhering to high conductivity materials without adhering to lower conductivity materials.

FIG. 8A illustrates a gripper 801 with a broad electrode pattern for adhering to high conductivity materials without adhering to lower conductivity materials. The gripper 801 includes a substrate 810 with a first electrode 812 disposed on or within a first region of the substrate 810 and a second electrode 814 disposed on or within a second region of the substrate 810. The first and second electrodes 812, 814 can be connected to respective terminals, which are then electrically connected to a voltage supply configured to apply voltages to the two electrodes 812, 814. For example, the first electrode 812 can receive a positive voltage (and is therefore labeled "+" in FIG. 8A and shown with cross-hatching for consistency with other positive terminals illustrated throughout) while the second electrode 814 can receive a corresponding negative voltage (and is therefore labeled "−" in FIG. 8A). The voltage applied between the two electrodes 812, 814 is selected such that the first electrode 812 receives a higher voltage than the second electrode 814. Generally, the voltage applied between the two electrodes can optionally be complementary positive and negative voltages referenced to a ground voltage.

The simple electrode pattern on the gripper 801 can induce an electroadhesion response in high conductivity materials, such as metals. Intermediate conductivity materials, such as cardboard, can also respond to the simple electrode pattern of the gripper 801, but may also require a higher voltage than that used to grip a conductive material such as metal. In some examples, the spatial separation between the two electrodes 812, 814 may be 2 to 5 centimeters (cm). In other cases, the spatial separation may be 3-10 millimeters (mm). In yet other cases, the spatial separation may be 0.25-2.5 mm.

Figure 8B:
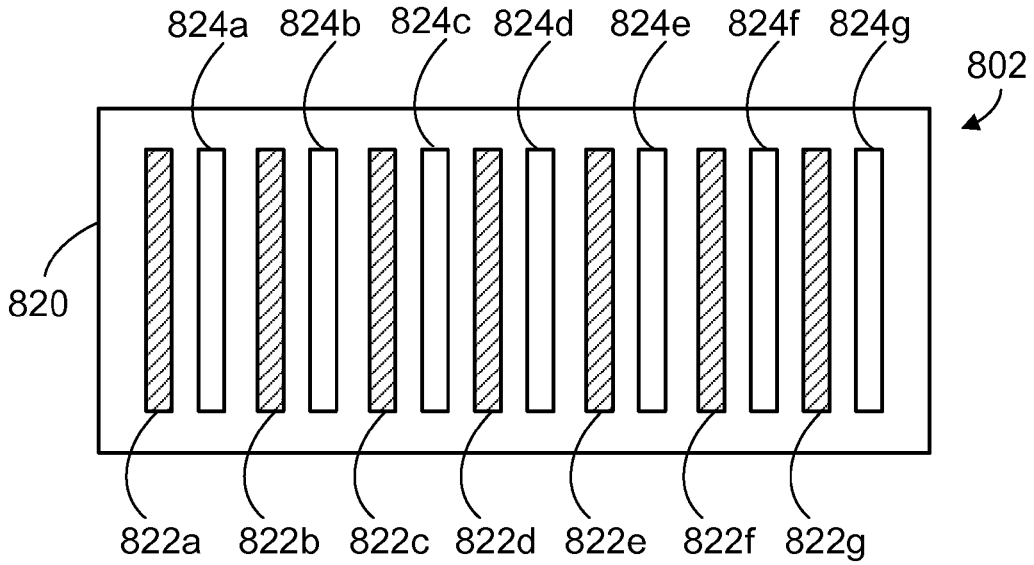
FIG. 8B illustrates a gripper with a fine electrode pattern for adhering to lower conductivity materials.

FIG. 8B illustrates a gripper 802 with a fine electrode pattern for adhering to lower conductivity materials. The gripper 802 includes a substrate 820 with a pattern of alternating positive electrodes 822*a-g* and negative electrodes 824*a-g*. The positive electrodes 822*a-g* and the negative electrodes 824*a-g* can each be disposed on or within the substrate 820. The multiple positive electrodes 822*a-g* (or negative electrodes 822*a-g*) can optionally be interconnected with one another to distribute applied voltage among the respective alternating electrodes of like polarity. With or without such interconnections, the respective polarity electrodes can be connected to respective terminals, which are then electrically connected to a voltage supply configured to apply voltages to the electrodes 822, 824. The voltage applied between the two electrodes 812, 814 is selected such that the first electrode 812 receives a higher voltage than the second electrode 814. Generally, the voltage applied between the two electrodes can optionally be complementary positive and negative voltages referenced to a ground voltage.

The finely patterned electrode pattern on the gripper 802 can induce an electroadhesion response in low conductivity materials, such as plastics, glass, and the like. In some examples, the spatial separation between the two electrodes 822, 824 may be 2 to 5 cm. In other cases, the spatial separation may be 3-10 mm. In yet other cases, the spatial separation may be 0.25-2.5 mm.

Figure 8C:
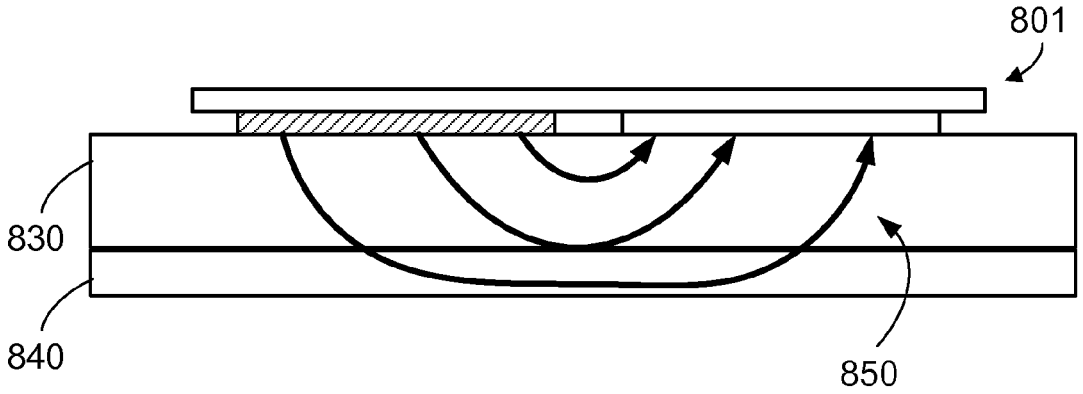
FIG. 8C illustrates the gripper shown in FIG. 8A adhered to an insulating material with a conductive backing.

FIG. 8C illustrates the gripper 801 shown in FIG. 8A adhered to an insulating material 830 with a conductive backing 840. The insulating material 830 may be, for example a sheet of glass or plastic. The conductive backing 840 may be, for example, a sheet of metallic foil and/or paper material. When voltage is applied to the electrodes of the gripper 801, the conductive backing 840 may become relatively more polarized than the insulator 830 (due to its relatively greater conductivity). The resulting electric field 850 in the insulator 830 and backing 840 may therefore pass through the conductive backing 840 instead of the insulator 830. The attraction to the conductive backing 840 can thus be used to adhere the combination of the insulator 830 and conductive backing 840 to the gripper 801.

Figure 8D:
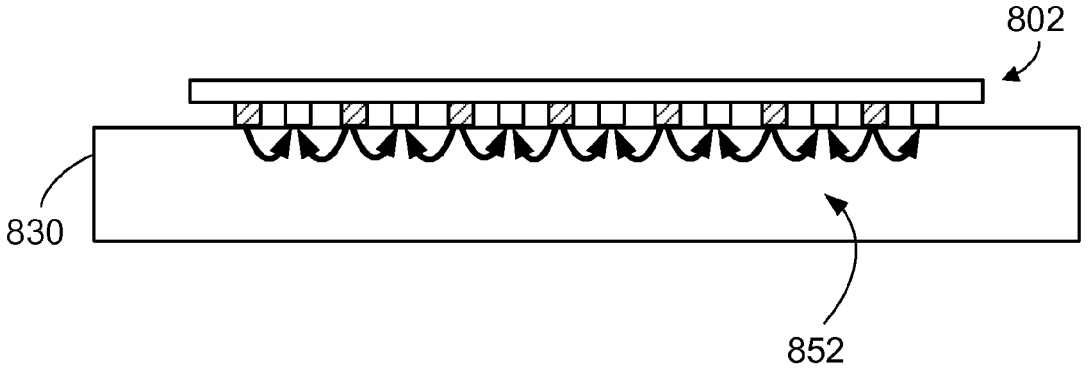
FIG. 8D illustrates the gripper shown in FIG. 8B adhered to an insulating material.

FIG. 8D illustrates the gripper 802 shown in FIG. 8B adhered to the insulating material 830. When voltage is applied to the finely spaced electrodes of the gripper 802, the insulating material is locally polarized in the regions nearest the oppositely charged electrodes, and an electric field 852 is generated within the insulating material 830. The induced electric field 852 is confined to a region of the insulating material 830 proximate the surface in contact with the gripper 802, and does not penetrate very deeply into the insulating material 830.

As shown in FIGS. 8C and 8D, the depth of penetration of the induced electric field depends, at least in part, on the electrode pattern of the gripper. For example, the finely patterned alternating electrodes on the gripper 802 induces an electroadhesive response (indicated by the field lines 852) with a smaller depth of penetration than the broad electrode pattern of the gripper 801. However, the attractive force on the insulator 830 is greater for the finely spaced electrode pattern of the gripper 802 than the broad pattern of the gripper 801. The relatively greater net force on the insulating material 830 can be due to the average magnitude of the induced electric field 852 being relatively greater, when averaged over the surface area of the insulating material 830 in contact with the gripper 802, than the average magnitude of the induced electric field 850. As a result, the adhesive pressure (i.e., force divided by area) on the insulating material 830 is therefore greater for the finely spaced electrode pattern of the gripper 802.

In some cases, a characteristic inter-electrode spacing of an electrode pattern may be related to a depth of penetration of the electrode pattern. For instance, some embodiments may employ an electrode pattern with a characteristic inter-electrode pattern that is at least approximately given by the thickness of the item being manipulated (or an outer layer of such item).

Some embodiments of the present disclosure provide for varying a depth of penetration of an electroadhesive force in accordance with an electrode pattern. Generally, more finely spaced electrode patterns provide relatively lower depth of penetration, whereas broader electrode patterns provide relatively greater depth of penetration. Grippers with different electrode patterns may therefore be used to pick up a different number of items in a stack, such as a stack of paper, currency, playing cards, etc. Similar to the discussion above in connection with FIGS. 4A-4B, the number of items lifted from the top of a stack can be controlled based on the spacing of the electrode pattern (e.g., based on the spatial frequency of alternating ones of the electrodes). For instance, one gripper with a relatively broad electrode pattern may be configured to adhere to 4 sheets of paper, and another gripper with a relatively fine electrode pattern may be configured to adhere to just 1 sheet of paper. Some embodiments even provide for dynamically varying the electrode pattern of a gripper dynamically to respond to particular gripping demands. Of course, the depth of penetration of the electroadhesive response generated by a particular gripper can also depend on the voltage applied to the electrodes as well as the inter-electrode spacing. As such, using variations in electrode pattern (e.g., as characterized by inter-electrode spacing or another measure of electrode spatial frequency) and/or variations in applied voltage, a customized electroadhesive response can be generated to adhere to a variety of foreign objects.

V. Example Material-Selective Sorting Systems

Given the ability to selectively adhere to items composed of various materials, sorting systems may be created that use one or more material-selective electroadhesive grippers to sort a group of intermixed articles based at least in part on the material properties of such articles. Such material-selective sorting systems may find applications in recycling handling applications where recyclable items are sorted by composition for further processing. Other potential applications include, without limitation, agricultural sorting systems for separating rice from husk, wheat from chaff, etc.; mining sorting systems for separating ore from mineral, metal from rock or sediment, etc.; and other sorting and handling applications. Material-selective grippers allow for at least partially automating a variety of sorting routines. Moreover, sorting systems may use material-selective electroadhesive grippers in combination with other material-selective technologies, such as magneto-attractive systems, which sort based on magnetic responsiveness of different items; air blowers, which sort based on density and/or air resistance of different items; and other technologies now known or later developed. Additionally or alternatively, sorting systems may employ item identifying systems configured to recognize and/or characterize certain items being sorted based on features of such items. Identifying systems may include (or communicate with), for example, vision systems configured to capture images of items and recognize symbols, characters, patterns (e.g., barcodes, QR codes, and the like) on such items, shape, reflectivity, dimensions, and/or color of the items; receiver systems configured to receive wireless signatures of such items (e.g., RFID signals and the like); infrared imaging systems, ultrasound scanning systems, and other systems configured to detect identifying information about items to be sorted and characterize the items accordingly. Electroadhesion can then be selectively applied to such items on the basis of such identification/characterization to effect sorting on the basis of the item-identifying information. In one example, systems may detect recycling symbols on materials to be processed for recycling (e.g., plastic bottles stamped with numeric recycling codes) and sort items based on the particular code detected.

Generally, any of the material-selective grippers disclosed herein in connection with FIGS. 1-8 can be tuned to particular voltages and/or electrode patterns to adhere to some materials without adhering to others. The material-dependent differential electroadhesive response can then be used to separate articles that adhere to the gripper from those that do not. For example, while articles are adhered thereto, the electroadhesive gripper can be moved with respect to the non-adhered articles. Once separated from the group, the adhered articles can be released from the gripper (e.g., by turning off or reducing the voltage on the electrodes).

The example sorting systems presented herein can include electroadhesive curtain grippers, for example, as discussed above in connection with FIGS. 5A-5B and 7A-7C, and/or electroadhesive conveyor belts, for example, as discussed above in connection with FIGS. 6A-6E. However, the examples provided herein are provided for purposes of illustration and example, and not limitation. It is particularly noted that alternative embodiments of systems material-selective electroadhesive grippers (or otherwise customized electroadhesive grippers) may be employed to sort items based on material composition, among other factors.

To facilitate understanding and for clarity in the description and drawings, articles composed of different materials are represented in the several drawings by blocks with different hatching patterns. Articles composed of relatively high conductivity materials (e.g., metal, etc.), are illustrated with a cross-hatch pattern of intersecting lines. Materials with intermediate conductivity (e.g., cardboard, etc.) are illustrated with a hatch pattern of parallel lines. Materials with relatively low conductivity (e.g., plastic, glass, etc.) are illustrated with no fill pattern.

Figure 9A:
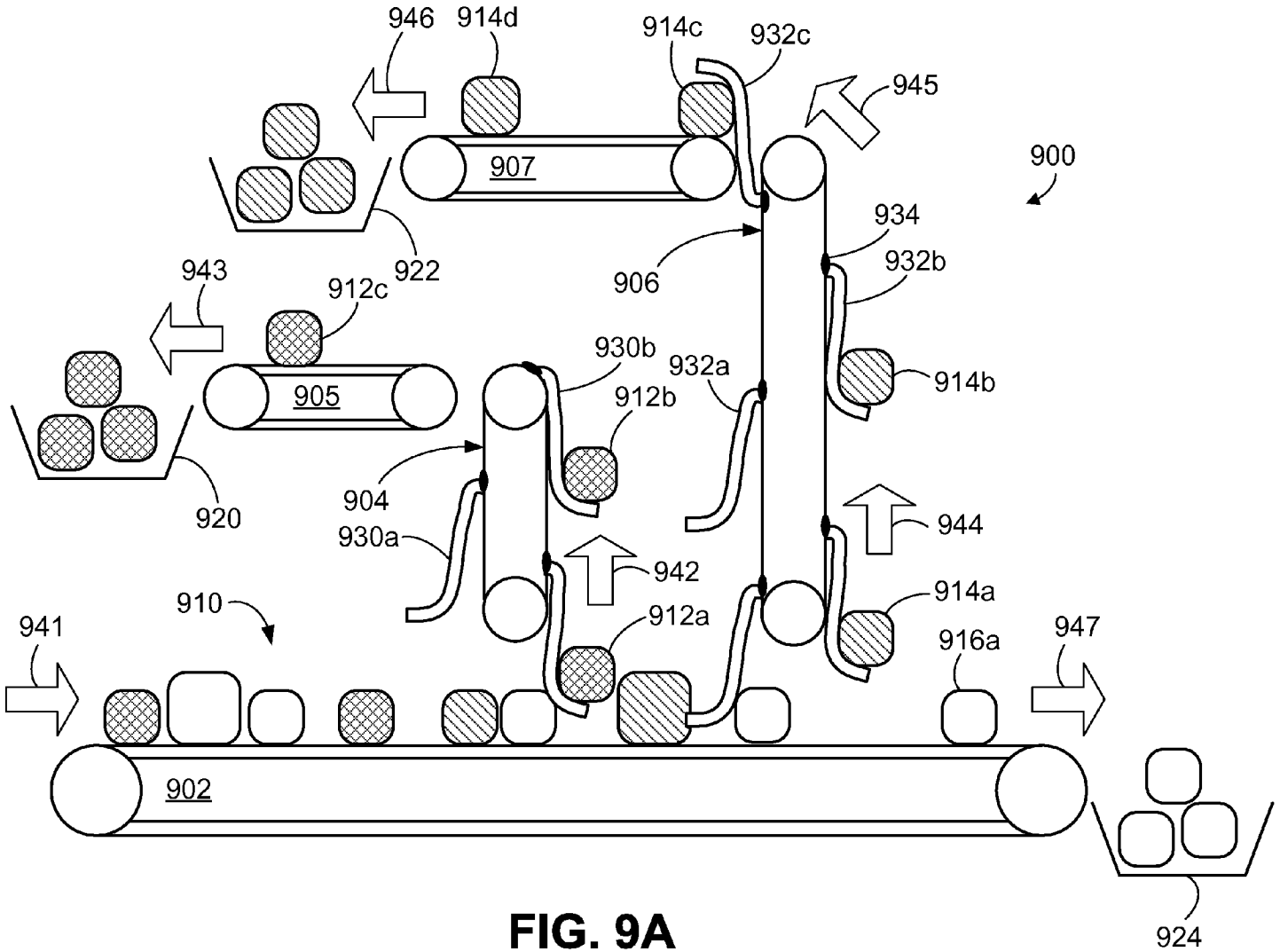
FIG. 9A is a simplified block diagram of an example system for sorting a group of intermixed materials using object-selective curtain grippers.

FIG. 9A is a simplified block diagram of an example system 900 for sorting a group of intermixed articles 910 using material-selective curtain grippers. A group of intermixed articles 910 is distributed on a moving surface of a conveyor belt 902, as indicated by arrow 941. The conveyor belt 902 moves the intermixed items to a first station for removing high conductivity materials 912. The first station includes a vertically oriented conveyor belt 904 with circulates electroadhesive curtains 930 tethered to the belt 904 by a pivoting mount, which allows the curtain to hang in either direction from the belt 904. The conveyor belt 904 is situated to allow the curtains 930 to repeatedly drape across the intermixed articles 910 moving past on the belt 902. The combination of the motion of the belt 902 moving the articles 910 and the motion of the curtain 930 via the vertical belt 904 causes the electroadhesive surface of the curtain 930 to be at least temporarily proximate multiple ones of the intermixed articles 910 in the region below the vertical belt 904. The curtain 930 may be manipulated such that its electroadhesive surface contacts substantially all of the articles conveyed along the belt 902. The curtain 930 is configured to induce an electroadhesive attraction with the high conductivity materials 912 without also attracting the other materials 914, 916. Generally, the curtain 930 may include an electrode geometry and/or polarization voltage that is tuned to be sufficient to attract the high conductivity materials 912 without also attracting the other materials 914, 916. For example, the curtain 930 may be set to an operating voltage of approximately 1 kV, similar to the curtain gripper described in FIG. 7A.

The continued motion of the vertical belt 904 lifts articles 912*a-b* composed of high conductivity material off of the conveyor belt 902, as indicated by directional arrow 942. The high conductivity articles 912*a-b* are then transferred to a secondary conveyor 905 by the curtain 930 flipping over the top of the vertical conveyor and the voltage being simultaneously turned off, to cause the high-conductivity article 912 to release from the curtain 930. One high conductivity article 912*c* is moving along the secondary conveyor 905 after being released from the curtain gripper 930*a*, which is on its way back down toward the conveyor 902 to adhere to another set of one or more high conductivity articles. The high conductivity article 912*c* can continue to a specified collection area 920 for the high conductivity material, as indicated by arrow 943. Thus, the first station operates to separate the high conductivity articles from the group of intermixed materials 910 by repeatedly placing the electroadhesive curtain 930 to contact the items in the group of intermixed materials 910. Because the curtain 930 is configured to adhere to the high conductivity materials without adhering to the other materials, subsequently moving the curtain 930 away from the intermixed group, while applying voltage to maintain the adhesion between the two, allows the high conductivity articles to be separated from the intermixed group 910.

Items remaining on the conveyor 902, such as the intermediate conductivity articles 914 and low conductivity articles 916, continue toward a second extraction station. The second station is similar to the first, but includes curtain grippers 932 configured to adhere to the intermediate conductivity articles 914 without also adhering to the low conductivity articles 916. The curtain grippers 932 are tethered to another vertical belt 906 by pivoting anchors 934 to allow the curtains 932 to hang in either direction from the respective anchor points. Generally, the curtains 932 may include an electrode geometry and/or polarization voltage that is tuned to induce an electroadhesive attraction with the intermediate conductivity materials 914 without also attracting the other articles remaining on the belt 902 (e.g., the low conductivity materials 916). For example, the curtain 932 may be set to an operating voltage of approximately 2.5 kV, similar to the curtain gripper described in FIG. 7. It is noted that the curtain grippers 932 may be configured to be capable of adhering to the high conductivity articles 912 as well, but the high conductivity articles 912 are removed from the conveyor belt 902 before reaching the second station.

The combination of the motion of the belt 902 moving the articles 914, 916 and the motion of the curtain 932 via the vertical belt 906 causes the electroadhesive surface of the curtain 932 to be at least temporarily proximate multiple ones of the intermixed articles in the region below the vertical belt 906. The curtain 932 may be manipulated such that its electroadhesive surface contacts substantially all of the articles conveyed along the belt 902, such as occurs while the curtain 934 is draped over the articles beneath the vertical belt 906.

Voltage is applied to the electrodes in the curtain 932 while it is draped over the belt 902, and the curtain 932 adheres to intermediate conductivity articles 914*a-d*. Continued motion of the vertical belt 906 lifts the adhered intermediate conductivity articles 914*a-d* upward and away from the belt 902, as shown by arrow 944. The intermediate conductivity articles 914*a-d* are then transferred to a secondary conveyor 907 by releasing the articles from the curtain 932 as the curtain 932 is pulled over the top pulley of the vertical conveyor 906, as indicated by arrow 945. Curtain 932*c* is shown just as the applied voltage is released, to allow the curtain 932*c* to detach from the intermediate conductivity article 914*c*, which is resting on the surface of the secondary conveyor 907. The secondary conveyor 907 moves the articles 914*c-d* to a collection area 922 for the intermediate conductivity material, as indicated by arrow 946.

Items remaining on the conveyor belt 902 then continue to a collection area 924 for low conductivity materials 916, as indicated by arrow 947. The items reaching the low conductivity collection area 924 are therefore items that were not removed from the conveyor 902 by the first station (via the curtains 930 for high conductivity materials) or by the second station (via the curtains 932 for intermediate conductivity materials). The system 900 thus sorts the group of intermixed articles 910 into respective collection areas 920, 922, 924 according to the conductivity of the articles in the group 910. Following such a sorting routine, another sorting technique may be employed to further separate materials. For example, a magnetic attraction system can be used to sort magnetic metals (e.g., iron, nickel, etc.) from non-magnetic metals (e.g., aluminum, etc.).

Figure 9B:
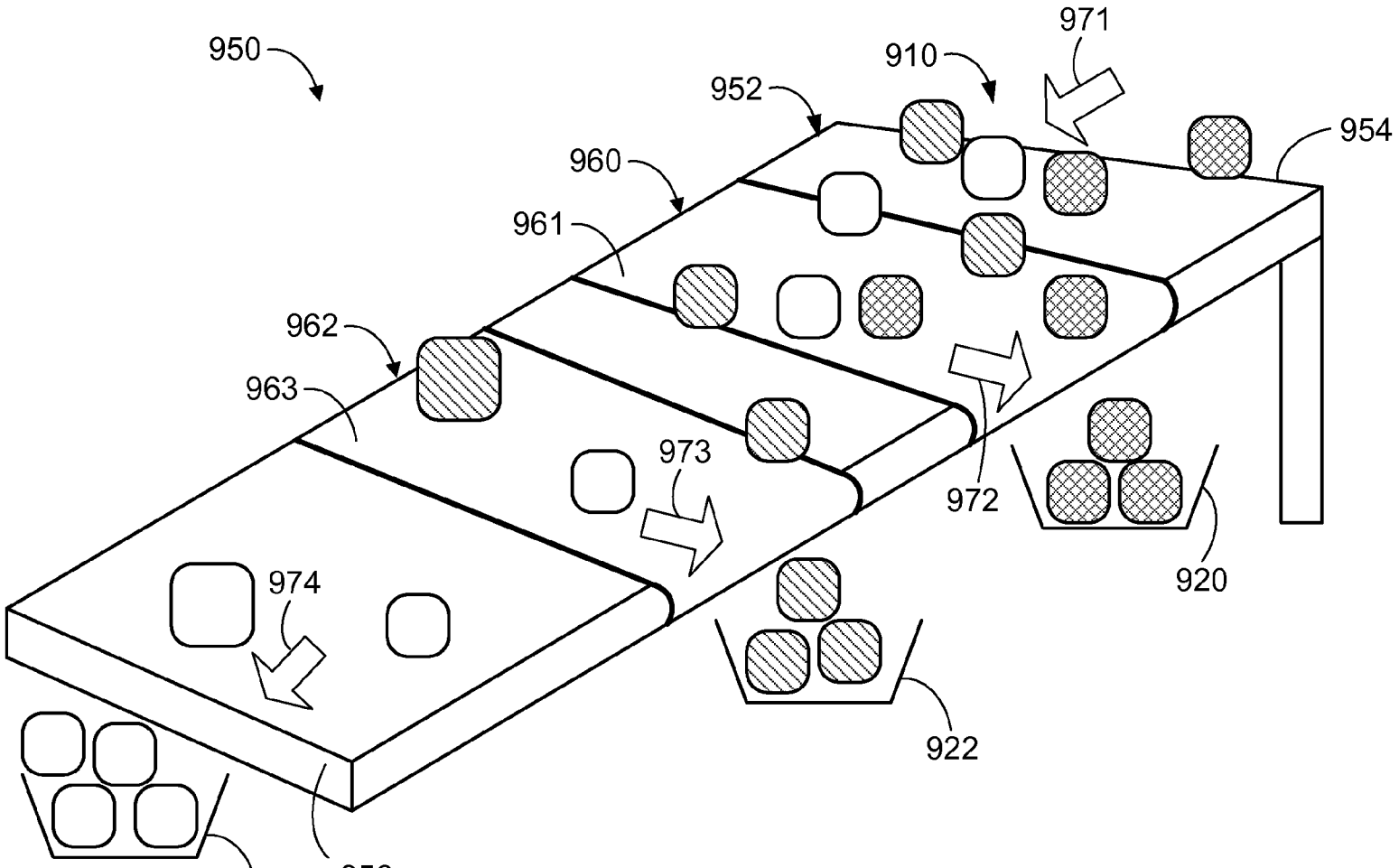
FIG. 9B is a block diagram of another example system for sorting a group of intermixed materials using object-selective conveyor belts on a sloped ramp.

FIG. 9B is a block diagram of another example system 950 for sorting a group of intermixed materials 910 using material-selective conveyor belts on a sloped ramp 952. The ramp 952 includes a high side 954, which is elevated relative to a low side 956. Items introduced at the high side 954 are therefore inclined to follow gravity to slide generally toward the low side 956, as indicated by the arrow 971. A pair of electroadhesive belts 960, 962 are situated across the ramp 952 to move along the surface of the ramp, transverse to the downward gradient of the ramp. A group of intermixed articles 910 are distributed near the high side 954 of the ramp 952. The articles 910 then slide, roll, tumble, or otherwise move generally downward along the gradient of the ramp 952. A first cross-wise electroadhesive belt 960 is configured to selectively adhere to high conductivity articles 912 without also adhering to the other materials. The outer surface 961 of the belt is approximately coplanar with the ramp 952, such that materials moving down the ramp pass over the outer surface 961 of the belt 960. The belt 960 can thereby trap high conductivity articles 912 that come in contact with it while moving down the ramp 952. The belt 960 moves the adhered high conductivity articles 912 off the side edge of the ramp 952, at which point electroadhesion can be deactivated to allow the high conductivity materials 912 to be delivered to a collection area 920 for the high conductivity materials, as indicated by arrow 972.

The other articles in the group of intermixed materials 910 do not adhere to the belt 960 and continue on to the second electroadhesive belt 962. The second cross-wise electroadhesive belt 962 is configured to selectively adhere to intermediate conductivity articles 914 without also adhering to the low conductivity materials 916. The second belt 962 adheres to the intermediate conductivity articles 914, via contact with the outer surface 963 of the belt 962. The belt 962 can then convey the intermediate conductivity articles adhered thereto toward the collection area 922 for intermediate conductivity materials, as indicated by the arrow 973. The remaining items (e.g., the low conductivity materials 916) then continue down the ramp 952 to the low side 956, where they are placed in a collection area 924 for the low conductivity materials, as indicated by arrow 974. The system 950 thus sorts the group of intermixed articles 910 into respective collection areas 920, 922, 924 according to the conductivity of the articles.

Figure 10B:
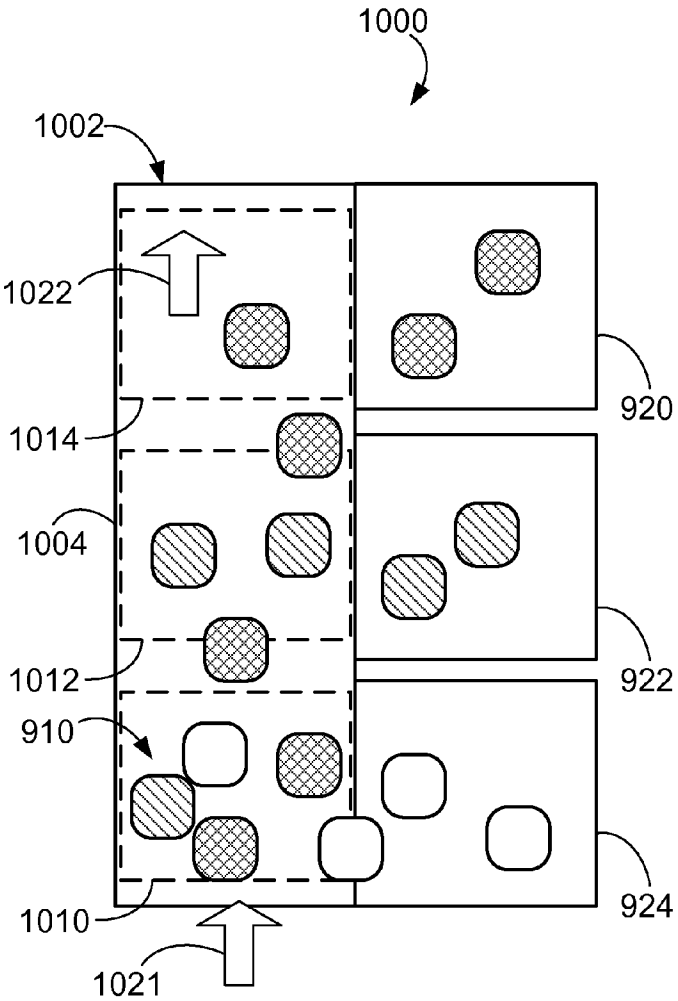
FIG. 10B is a top view of the example material-selective sorting system shown in FIG. 10A.
Figure 10A:
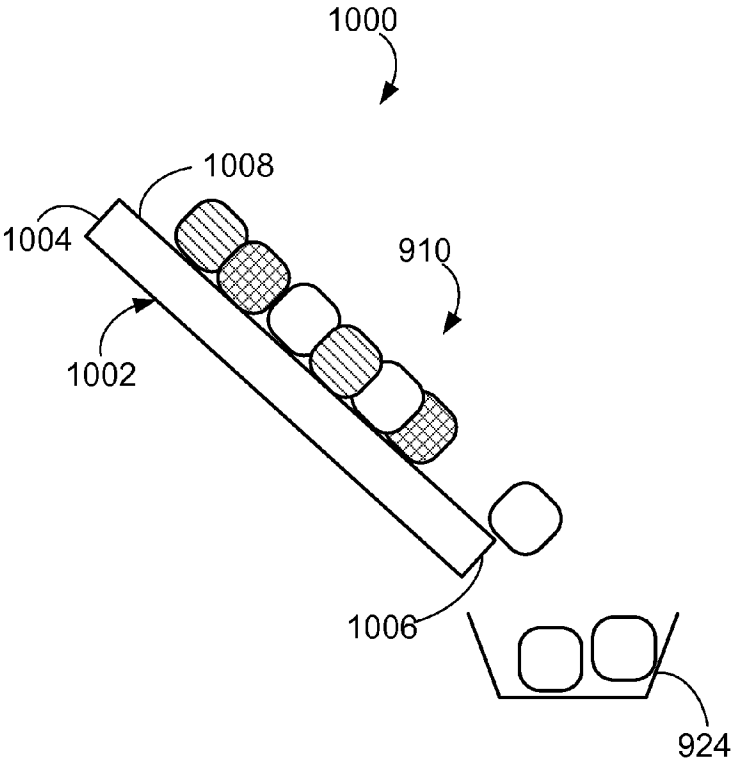
FIG. 10A is an end view of an example material-selective sorting system using an inclined conveyor with object-selective separately addressable subsections.

FIG. 10A is an end view of an example material-selective sorting system 1000 using an inclined conveyor 1002 with material-selective separately addressable subsections. FIG. 10B is a top view of the example material-selective sorting system 1000 shown in FIG. 10A. The system 1000 includes a conveyor track 1002 that is oriented with a slope transverse to its direction of conveyance. That is, the slope gradient is along the width of the belt, not the length, and is therefore substantially perpendicular to the direction of motion of the belt 1002. Items 910 on the belt 1002 are adhered to the outer surface 1008 by the electroadhesive force, which prevents items from sideways off of the belt 1002. The belt has a high side edge 1004 and an opposite low side edge 1006, and items are generally urged (by gravity) to slide, tumble, roll, or otherwise move across the belt 1002, generally from the high side edge 1004 to the low side edge 1006. The belt 1002 can include separately addressable sections 1010, 1012, 1014, which can be operated at different voltages to cause the belt 1002 to exhibit material selective electroadhesion while in each section. Thus, each of subsections 1010-1014 can include respective rolling connectors for applying different voltages to the terminals along the inner side of the belt 1002.

The group of intermixed materials 910 is passed through regions of successively decreasing electroadhesion such that the articles detach from the outer surface 1008 of the belt 1002 and fall toward one of the collection areas 920-924 roughly in order of conductivity. For example, the group of intermixed items 910 can initially be distributed along the belt 910 in a region where the belt exhibits a relatively strong electroadhesive attraction, which causes substantially all of the intermixed articles to be attracted to the belt 1002.

The intermixed group 910 then moves to the first subsection 1010, as indicated by the arrow 1021. The first subsection 1010 receives an applied voltage sufficient to adhere to the high conductivity materials 912 and the intermediate conductivity materials 914, but not the low conductivity materials 916. Thus, upon reaching the first subsection 1010, the low conductivity materials 916 detach from the surface 1008 of the belt 1002, and fall over the low side edge 1006 to the collection area 924 for the low conductivity materials. FIG. 10A illustrates one low conductivity article 916 moving over the low side edge 1006 to fall into the collection area 924.

The remaining articles (e.g., high and intermediate conductivity articles) continue on the conveyor belt 1002 to a second subsection 1012. The second subsection 1012 receives an applied voltage sufficient to adhere to the high conductivity materials 912, but not the intermediate conductivity materials 914. Thus, upon reaching the second subsection 1012, the intermediate conductivity materials 914 detach from the surface 1008 of the belt 1002, and fall over the low side edge 1006 to the collection area 922 for the intermediate conductivity materials.

Finally, the remaining high conductivity articles 912 continue toward a third subsection 1014. At the third subsection 1014 the electroadhesion is reduced even further (perhaps even turned off) to cause the high conductivity articles 912 to detach from the surface 1008 of the belt 1002 and fall over the low side edge 1006 to the collection area 920 for high conductivity materials. The system 1000 thus sorts the group of intermixed articles 910 into respective collection areas 920, 922, 924 according to the conductivity of the articles. In particular, the system 1000 utilizes the material-selective adhesion of the various subsections 1010-1014 to cause released articles to follow an inertial path, down the gradient of the inclined conveyor belt 1002, rather than a path followed by any remaining adhered ones of the intermixed articles 910.

Figure 10C:
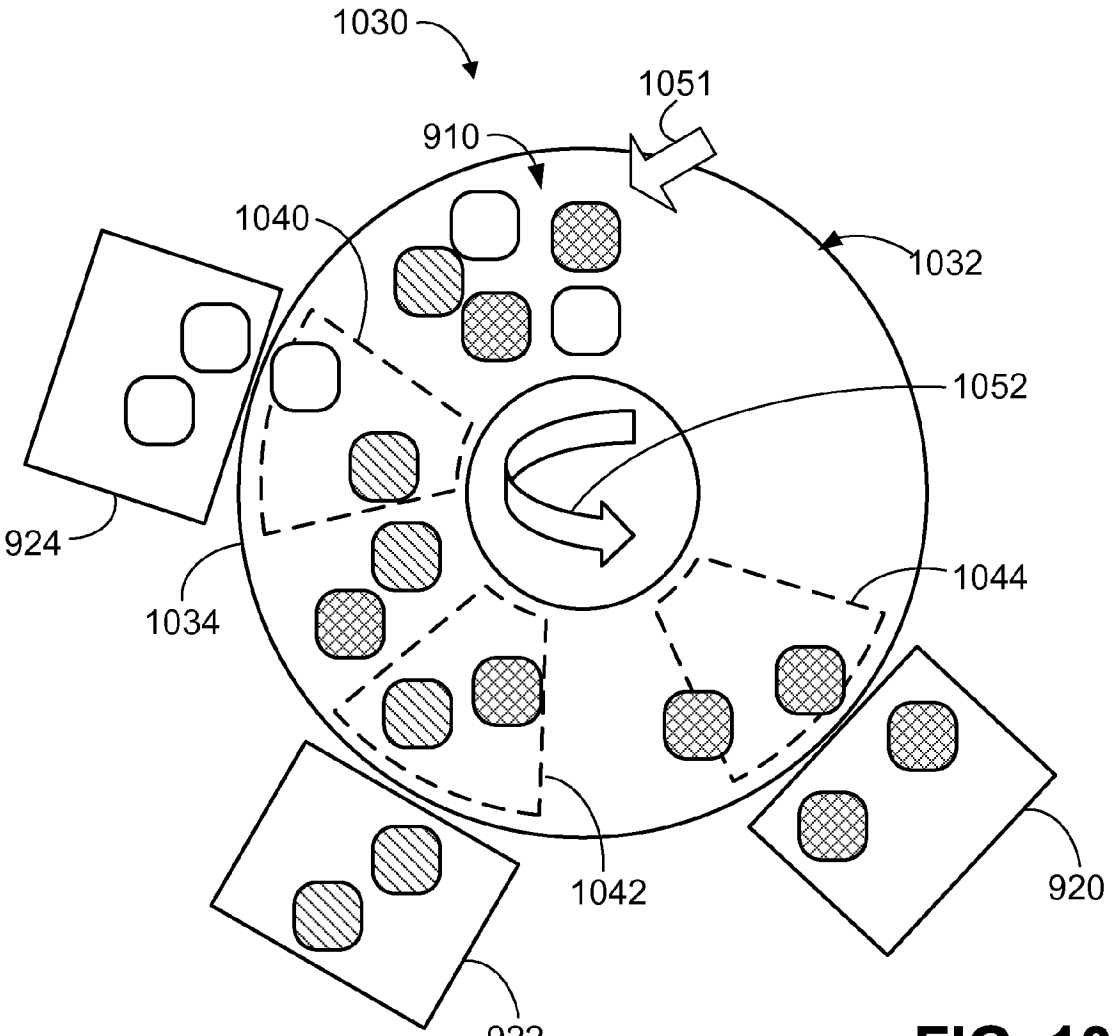
FIG. 10C is a top view of another example material-selective sorting system using a rotating conveyor with object-selective separately addressable subsections.

FIG. 10C is a top view of another example material-selective sorting system 1030 using a rotating conveyor 1032 with material-selective separately addressable subsections 1040-1044. The rotating conveyor 1032 undergoes planar rotation, as indicated by the arrow 1052. While the conveyor 1032 rotates, items situated thereon are prevented from sliding radially outward (e.g., due to the centrifugal inertia) by electroadhesive attraction with the rotating conveyor 1032.

However, the separately addressable regions provide sequentially decreased electroadhesion forces to allow articles on the conveyor to predictably and controllably slide off of the rotating surface toward a respective collection area 920-924. After the group of intermixed articles 910 is distributed along the rotating conveyor 1032, as indicated the arrow 1051, the rotating conveyor 1032 can operate at a relatively high voltage to adhere to substantially all of the received materials. Upon reaching the first subsection 1040, however, the applied voltage can be reduced to a level sufficient to adhere to the high conductivity materials 912 and the intermediate conductivity materials 914, but not the low conductivity materials 916. Thus, upon reaching the first subsection 1040, the low conductivity materials 916 detach from the surface of the rotating conveyor 1032, and follow the centrifugal inertia over the outer side edge 1034 to the collection area 924 for the low conductivity materials.

Remaining articles (e.g., high conductivity and intermediate conductivity articles 912, 914) are conveyed toward the second subsection 1042, as indicated by the circulating arrow 1052. In the second subsection 1042, the belt 1032 receives a lower voltage that is sufficient to adhere to the high conductivity articles 912 without also adhering to the intermediate conductivity articles 914. As a result, the intermediate conductivity materials detach from the surface of the rotating conveyor, and follow the centrifugal inertia radially outward over the outer side edge 1034 to the collection area 922 for the intermediate conductivity materials.

The high conductivity articles 912 are then conveyed to the third subsection 1044, at which point the electroadhesive voltage is reduced even further (perhaps even turned off) to cause the high conductivity articles 912 to detach from the surface of the rotating conveyor 1032 and fall over the outer side edge 1034 to the collection area 920 for high conductivity materials. The system 1030 thus sorts the group of intermixed articles 910 into respective collection areas 920, 922, 924 according to the conductivity of the articles. In particular, the system 1030 utilizes the material-selective adhesion of the various subsections 1040-1044 to cause released articles to follow an inertial path, radially outward along the surface of the rotating conveyor 1032, rather than a path followed by any remaining adhered ones of the intermixed articles 910.

VI. Example Operations

Figure 11A:
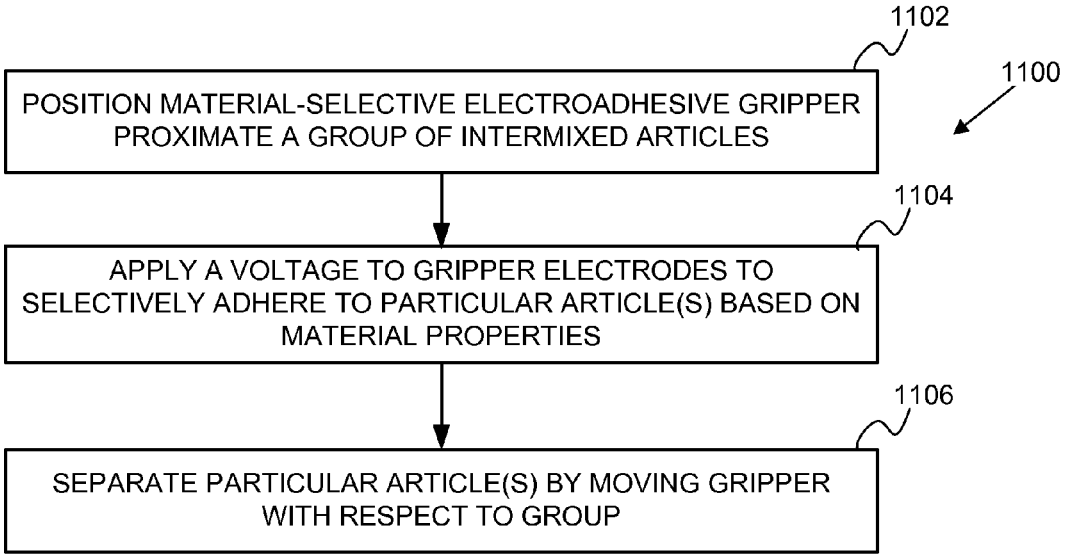
FIG. 11A is a flowchart of an example process for separating particular articles from a group of articles.

FIG. 11A is a flowchart of an example process 1100 for separating particular articles from a group of articles. The process 1100 may be carried out by any one of the examples systems described in connection with FIGS. 9-10 above. A material-selective electroadhesive gripper is positioned proximate a group of intermixed articles (1102). For example, one or more conveyor belts, pulleys, etc. can be used to drive an electroadhesive surface, such as a curtain gripper, conveyor belt, etc., to contact (or nearly contact) the group of articles. A voltage is applied to the gripper electrodes to cause the gripper to adhere to particular articles based on the material composition of the articles (1104). For example, a subset of the articles can selectively adhere to the electroadhesive surface of the gripper based on the subset of articles having different material properties than other articles in the group. Additionally or alternatively, the gripper can be caused to selectively adhere to particular articles based on external sensor inputs coming from a variety of sensors mounted either on the electroadhesive gripper or external to it. The material-selective gripping response of the gripper may be due to electrode geometry and/or magnitude of the applied voltage, as described generally in connection with FIGS. 7-8. The particular articles adhered to the material-selective gripper are then separated from the group by moving the gripper with respect to the group (1106). The relative motion of the gripper and the group may be facilitated by one or more conveyor belts, pulleys, etc., as described in the systems described in connection with FIGS. 9-10 above.

In some cases, blocks 1102 and/or 1106 may involve the gripper being moved while the group of articles remains stationary (e.g., an electroadhesive curtain gripper moved across the group). In some cases, blocks 1102 and/or 1106 may involve the group of articles being moved while the gripper remains stationary (e.g., a group of articles conveyed under an electroadhesive curtain gripper that is draped over the path of the articles). In some cases, blocks 1102 and/or 1106 may involve both the gripper and the group of articles being moved (e.g., as in the arrangement in the system 900 of FIG. 9A).

Figure 11B:
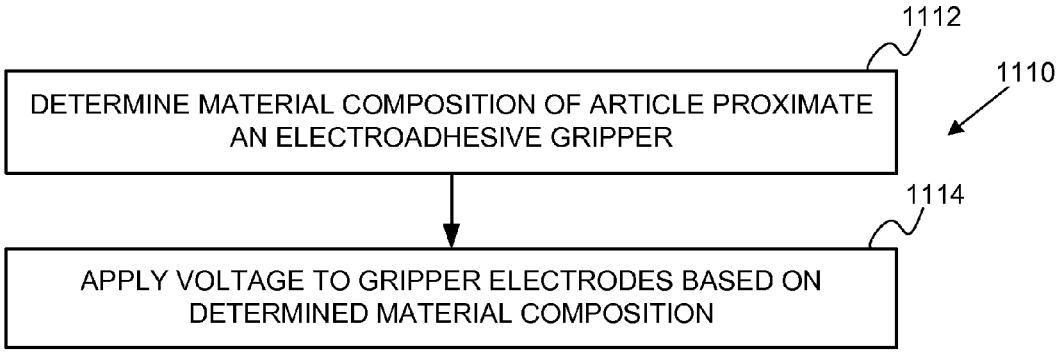
FIG. 11B is a flowchart of an example process for determining a voltage to apply to an electroadhesive gripper based on an indication of the material being gripped.

FIG. 11B is a flowchart of an example process 1110 for determining a voltage to apply to an electroadhesive gripper based on an indication of the material being gripped. Generally, any of example electroadhesive gripping systems described herein, such as in connection with FIGS. 5-6 and elsewhere, may include a sensor system for detecting an indication of material composition of particular materials (e.g., via image recognition, radiation reflectivity signatures, etc.). Additionally or alternatively, the electroadhesive gripping systems may receive an indication of material composition of a particular item from an external sensing system (e.g., via communication with the controllers 510 or 616 of FIGS. 5-6). The process 1110 involves determining a material composition of a particular article proximate an electroadhesive gripper (1112). Such a determination may include, for example, receiving an indication from an external material detection system. Upon determining the material composition, a voltage can be selected to apply to the electroadhesive gripping system based in part on the determined material composition (1114). For example, the applied voltage can be selected to cause the electroadhesive gripper to be sufficient to adhere to the material, to ensure that the particular item is able to be manipulated by the gripper. Alternatively, the applied voltage can be set to be insufficient to enable the gripper to adhere to the material, to cause the particular item to be released from (or never adhere to) the gripper. To facilitate block 1114, a look up table or other correlation data may be referenced to associate a particular indicated material with a voltage magnitude to be applied. Such a look up table and/or correlation data may optionally include indications of a range of voltages that may be applied, and how to select a voltage within the range depending on other factors, such as electrode geometry, density and/or weight of the particular item, etc.

Figure 12:
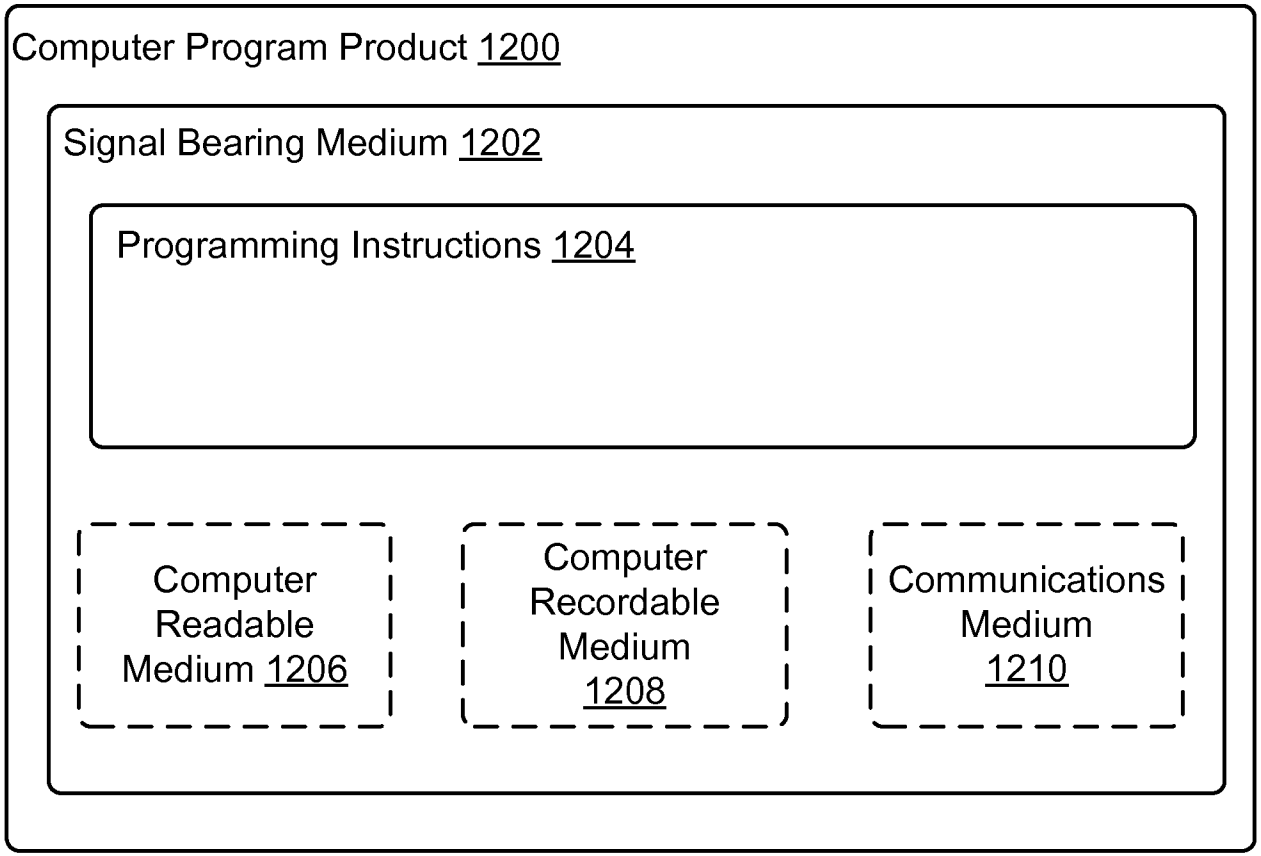
FIG. 12 depicts a computer-readable medium configured according to an example embodiment.

FIG. 12 depicts a computer-readable medium configured according to an example embodiment. In example embodiments, the example system can include one or more processors, one or more forms of memory, one or more input devices/interfaces, one or more output devices/interfaces, and machine-readable instructions that when executed by the one or more processors cause the system to carry out the various functions, tasks, capabilities, etc., described above.

As noted above, in some embodiments, the disclosed techniques can be implemented by computer program instructions encoded on a non-transitory computer-readable storage media in a machine-readable format, or on other non-transitory media or articles of manufacture. FIG. 12 is a schematic illustrating a conceptual partial view of an example computer program product that includes a computer program for executing a computer process on a computing device, arranged according to at least some embodiments presented herein, including the processes shown and described in connection with FIG. 11.

In one embodiment, the example computer program product 1200 is provided using a signal bearing medium 1202. The signal bearing medium 1202 may include one or more programming instructions 1204 that, when executed by one or more processors may provide functionality or portions of the functionality described above with respect to FIGS. 1-11. In some examples, the signal bearing medium 1202 can include a non-transitory computer-readable medium 1206, such as, but not limited to, a hard disk drive, a Compact Disc (CD), a Digital Video Disk (DVD), a digital tape, memory, etc. In some implementations, the signal bearing medium 1002 can be a computer recordable medium 1208, such as, but not limited to, memory, read/write (R/W) CDs, R/W DVDs, etc. In some implementations, the signal bearing medium 1202 can be a communications medium 1210, such as, but not limited to, a digital and/or an analog communication medium (e.g., a fiber optic cable, a waveguide, a wired communications link, a wireless communication link, etc.). Thus, for example, the signal bearing medium 1202 can be conveyed by a wireless form of the communications medium 1210.

The one or more programming instructions 1204 can be, for example, computer executable and/or logic implemented instructions. In some examples, a computing device is configured to provide various operations, functions, or actions in response to the programming instructions 1204 conveyed to the computing device by one or more of the computer readable medium 1206, the computer recordable medium 1208, and/or the communications medium 1210.

The non-transitory computer readable medium 1206 can also be distributed among multiple data storage elements, which could be remotely located from each other. The computing device that executes some or all of the stored instructions can be a microfabrication controller, or another computing platform. Alternatively, the computing device that executes some or all of the stored instructions could be remotely located computer system, such as a server.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims.

What is claimed is:

1. A method comprising:

manipulating at least one of an electroadhesive surface or a plurality of articles such that multiple ones of the plurality of articles are at least intermittently proximate the electroadhesive surface, wherein the electroadhesive surface includes a plurality of electrodes and the plurality of electrodes includes at least one positive electrode and at least one negative electrode;

determining a material composition of a particular article proximate the electroadhesive surface, wherein determining the material composition of the particular article proximate the electroadhesive surface comprises receiving an indication of the material composition from a material detection system;

selecting a voltage based on the determined material composition;

applying the selected voltage between the at least one positive electrode and the at least one negative electrode in the electroadhesive surface to thereby cause the electroadhesive surface to selectively adhere to a subset of the plurality of articles based on the subset of the plurality of articles having different material properties than others of the plurality of articles; and while applying the selected voltage between the at least one positive electrode and the at least one negative electrode in the electroadhesive surface, moving the electroadhesive surface with respect to the others of the plurality of articles to thereby separate the subset of the plurality of articles from the others of the plurality of articles.

2. The method according to claim 1, wherein the plurality of articles includes one or more articles substantially formed of a first material intermixed with one or more articles substantially formed of a second material, and wherein the electroadhesive surface is configured to adhere to the first material without adhering to the second material while the selected voltage is applied such that moving the electroadhesive surface with respect to the plurality of articles separates the one or more articles formed substantially of the first material from one or more articles formed substantially of the second material.

3. The method according to claim 2, wherein the first material and the second material are each one of a plastic material, a metal material, a glass material, or a paper fiber based material.

4. The method according to claim 1, further comprising:

manipulating at least one of a second electroadhesive surface or the others of the plurality of articles such that multiple ones of the others of the plurality of articles are at least intermittently proximate the second electroadhesive surface;

applying a voltage between a positive electrode and a negative electrode in the second electroadhesive surface to thereby cause the second electroadhesive surface to selectively adhere to a second subset of the plurality of articles; and while applying the voltage between the positive electrode and the negative electrode in the second electroadhesive surface, moving the second electroadhesive surface with respect to the others of the plurality of articles to thereby separate the second subset of the plurality of articles from the others of the plurality of articles.

5. The method according to claim 1, wherein the electroadhesive surface includes a compliant curtain with integrated flexible electrodes, and wherein the manipulating includes draping the compliant curtain over the plurality of articles such that the electroadhesive surface at least partially conforms to be proximate exposed surfaces of multiple ones of the plurality of articles.

6. The method according to claim 1, wherein the electroadhesive surface includes a conveyable surface with integrated electrodes configured to convey the subset of the plurality of articles adhered to the electroadhesive surface along a predetermined path different from an inertial path being traversed by the others of the plurality of articles, and wherein the manipulating includes distributing the plurality of articles over the conveyable surface such that the electroadhesive surface is proximate surfaces of multiple ones of the plurality of articles.

7. The method according to claim 1, wherein the moving the electroadhesive surface with respect to the others of the plurality of articles includes urging the electroadhesive surface so as to cause the subset of the plurality of articles adhered to the electroadhesive surface to depart from an inertial path traversed by the others of the plurality of articles.

8. A system comprising:

an electroadhesive surface including a plurality of electrodes, wherein the plurality of electrodes includes at least one positive electrode and at least one negative electrode;

a voltage supply;

an article manipulator configured to convey the plurality of articles to the electroadhesive surface such that multiple ones of the plurality of articles are at least intermittently proximate the electroadhesive surface;

a material detection system configured to detect a material composition of a particular article proximate the electroadhesive surface;

a controller configured to: (i) receive an indication of the material composition from the material detection system, (ii) select a voltage based on the material composition, (iii) control the voltage supply to apply the selected voltage between the at least one positive electrode and the at least one negative electrode in the electroadhesive surface to thereby cause the electroadhesive surface to selectively adhere to a subset of the plurality of articles based on the subset of the plurality of articles having different material properties than others of the plurality of articles, and (iv) while the selected voltage is applied between the at least one positive electrode and the at least one negative electrode in the electroadhesive surface, cause the electroadhesive surface to move with respect to the others of the plurality of articles to thereby separate the subset of the plurality of articles from the others of the plurality of articles.

9. The system according to claim 8, wherein the plurality of articles includes one or more articles substantially formed of a first material intermixed with one or more articles substantially formed of a second material, and wherein the electroadhesive surface is configured to adhere to the first material without adhering to the second material while the selected voltage is applied such that moving the electroadhesive surface with respect to the plurality of articles separates the one or more articles formed substantially of the first material from one or more articles formed substantially of the second material.

10. The system according to claim 9, wherein the first material and the second material are each one of a plastic material, a metal material, a glass material, or a paper fiber based material.

11. The system according to claim 8, further comprising:

a second electroadhesive surface including a positive electrode and a negative electrode, wherein the article manipulator is configured to convey the others of the plurality of articles to the second electroadhesive surface such that multiple ones of the plurality of articles are at least intermittently proximate the second electroadhesive surface, and wherein the controller is further configured to: (i) control the voltage supply to apply a voltage between the positive electrode and the negative electrode in the second electroadhesive surface to thereby cause the second electroadhesive surface to selectively adhere to a second subset of the plurality of articles, and (ii) while the voltage is applied between the positive electrode and the negative electrode in the second electroadhesive surface, cause the second electroadhesive surface to move with respect to the others of the plurality of articles to thereby separate the second subset of the plurality of articles from the others of the plurality of articles.

12. The system according to claim 8, wherein the article manipulator includes a conveyor belt configured to convey the plurality of articles along a predetermined path determined, at least in part, by a path traversed by a conveyable surface of the conveyor belt.

13. The system according to claim 8, wherein the article manipulator includes a ramp configured to convey the plurality of articles along a predetermined path determined, at least in part, by gravitational forces urging the plurality of articles along a downward slope of the ramp.

14. The system according to claim 8, wherein the electroadhesive surface is included in a compliant curtain with integrated flexible electrodes.

15. The system according to claim 8, wherein the electroadhesive surface is included in a conveyable surface of a conveyor belt with integrated electrodes.

16. The system according to claim 8, further comprising:

a positioning system for urging the electroadhesive surface to move with respect to the others of the plurality of articles.

17. The system according to claim 16, wherein the positioning system is configured to separate the subset of articles from the others of the plurality of articles by urging the electroadhesive surface so as to cause the subset of the plurality of articles adhered to the electroadhesive surface to depart from an inertial path traversed by the others of the plurality of articles.

* * * * *